US011002027B2

(12) United States Patent
Titcomb et al.

(10) Patent No.: US 11,002,027 B2
(45) Date of Patent: May 11, 2021

(54) STACKING CLIP FOR CONCRETE FORMING PANEL SYSTEMS

(71) Applicant: Titcomb Brothers Manufacturing, Inc., Westport, MA (US)

(72) Inventors: Paul S. Titcomb, Providence, RI (US); Ted Titcomb, Cotuit, MA (US)

(73) Assignee: Titcomb Brothers Manufacturing, Inc., Westport, MA (US)

( * ) Notice: Subject to any disclaimer, the term of this patent is extended or adjusted under 35 U.S.C. 154(b) by 0 days.

(21) Appl. No.: 16/773,855

(22) Filed: Jan. 27, 2020

(65) Prior Publication Data

US 2020/0157808 A1 May 21, 2020

Related U.S. Application Data

(63) Continuation-in-part of application No. 16/748,620, filed on Jan. 21, 2020, which is a continuation-in-part of application No. 16/252,281, filed on Jan. 18, 2019.

(60) Provisional application No. 62/796,934, filed on Jan. 25, 2019, provisional application No. 62/794,429, filed on Jan. 18, 2019, provisional application No. 62/619,545, filed on Jan. 19, 2018.

(51) Int. Cl.

| | |
|---|---|
| ***E04G 17/04*** | (2006.01) |
| ***E04B 1/38*** | (2006.01) |
| ***E04G 17/02*** | (2006.01) |
| *B28B 7/00* | (2006.01) |

(52) U.S. Cl.

CPC ..... *E04G 17/04* (2013.01); *E04G 17/02* (2013.01); *B28B 7/0014* (2013.01); *E04B 2001/405* (2013.01)

(58) Field of Classification Search

CPC ..... B28B 7/0014; E04G 17/02; E04G 17/04; E04B 2001/405

USPC ..... 248/248, 300, 301, 304, 211, 215, 248/220.41, 222.51, 222.52, 225.21, 247, 248/225.11; 249/219.1, 192, 47; 52/712, 52/714

See application file for complete search history.

(56) References Cited

U.S. PATENT DOCUMENTS

| | | | | | |
|---|---|---|---|---|---|
| 371,665 | A | * | 10/1887 | Brinkerhoff | A47G 1/16 248/489 |
| 1,020,916 | A | * | 3/1912 | Lanier | F21V 21/08 248/214 |
| 1,429,412 | A | * | 9/1922 | Davidson | E04G 17/02 249/18 |
| 1,540,570 | A | * | 6/1925 | Roberts | E04G 17/045 249/205 |
| 1,552,334 | A | * | 9/1925 | Mosher | E04G 17/001 249/219.1 |

(Continued)

FOREIGN PATENT DOCUMENTS

| | | | | | |
|---|---|---|---|---|---|
| DE | 102010013960 | A1 | * | 10/2011 | E04G 17/04 |
| EP | 0278803 | | * | 8/1988 | A47G 1/22 |

(Continued)

*Primary Examiner* — Michael Safavi

(74) *Attorney, Agent, or Firm* — Nelson Mullins Riley & Scarborough LLP; Anthony A. Laurentano

(57) ABSTRACT

A stacking clip suitable for use with a concrete forming system having one or more frame elements having one or more ribs formed on a rail. The stacking clip allows an extension component to be coupled to the stacking clip and to hence extend the height or the width of the frame element.

9 Claims, 21 Drawing Sheets

(56) References Cited

U.S. PATENT DOCUMENTS 1,594,973 A * 8/1926 Moser ..... E04G 17/02 403/399
1,615,338 A * 1/1927 Moser ..... E04G 17/02 403/399
1,925,221 A * 9/1933 Wotnoske ..... E04G 17/04 249/219.1
1,931,834 A * 10/1933 Wotnoske ..... E04G 17/04 249/195
1,987,076 A * 1/1935 Pulis ..... E04G 17/045 269/47
3,601,356 A * 8/1971 Yurick ..... E04G 17/042 249/92
3,628,762 A * 12/1971 Williams ..... F25D 23/04 248/235
3,795,380 A * 3/1974 Turner ..... A47H 1/10 248/263
3,917,216 A * 11/1975 Plough ..... E04G 17/001 249/48
3,923,278 A * 12/1975 Marcil ..... A47G 1/20 248/301
4,098,480 A * 7/1978 Neumann ..... A47B 57/045 211/153
4,103,854 A * 8/1978 Pliml ..... F16B 5/0685 248/222.11
4,205,815 A * 6/1980 Sauer ..... A47B 57/42 211/192
4,367,819 A * 1/1983 Lewis ..... A47G 25/0678 211/106.01
4,832,298 A * 5/1989 Metcalf ..... A47F 5/083 211/59.1
5,154,388 A * 10/1992 Magaro ..... A47B 96/061 108/108
5,181,683 A * 1/1993 Smith ..... A01K 39/01 248/231.31
5,899,035 A * 5/1999 Waalkes ..... E04B 2/7433 52/239
6,315,489 B1 * 11/2001 Watanabe ..... E04F 13/0846 403/381
7,014,155 B1 * 3/2006 Schnabel ..... A47B 47/03 211/192
7,201,355 B1 * 4/2007 Zien ..... A01K 5/01 248/301
7,497,344 B2 * 3/2009 Chen ..... A47B 57/40 108/108
8,281,537 B2 * 10/2012 O'Shea ..... E04F 13/0855 52/506.06
2002/0047073 A1 * 4/2002 Deciry ..... H02G 3/32 248/49
2003/0197102 A1 * 10/2003 Lin ..... A47B 57/42 248/220.43
2005/0056749 A1 * 3/2005 Simard ..... A47B 57/34 248/248
2005/0230577 A1 * 10/2005 Chen ..... A47B 55/02 248/215
2012/0211609 A1 * 8/2012 Mandic ..... H02G 3/0406 248/65
2015/0136924 A1 * 5/2015 Lachance ..... A47B 57/425 248/222.41
2019/0226513 A1 * 7/2019 Ubinana Felix ..... E04G 17/04

FOREIGN PATENT DOCUMENTS

EP 0595309 A2 * 5/1994 ..... A47B 47/027
WO WO-2016189182 A1 * 12/2016 ..... E04G 17/02

* cited by examiner

STACKING CLIP FOR CONCRETE FORMING PANEL SYSTEMS

RELATED APPLICATION

The present application claims priority to provisional patent application Ser. No. 62/796,934, filed on Jan. 25, 2019, entitled STACKING CLIP FOR CONCRETE FORMING PANEL SYSTEMS, and is a continuation-in-part patent application of U.S. patent application Ser. No. 16/748,620, filed on Jan. 21, 2020, entitled LOOP TIE FOR CONCRETE FORMING PANEL SYSTEMS, which in turn claims priority to provisional patent application Ser. No. 62/794,429, filed Jan. 18, 2019, entitled LOOP TIE FOR CONCRETE FORMING PANEL SYSTEMS, and which in turn is a continuation-in-part patent application of patent application Ser. No. 16/252,281, filed Jan. 18, 2019, and entitled LOOP TIE FOR CONCRETE FORMING PANEL SYSTEMS, which in turn claims priority to U.S. provisional patent application Ser. No. 62/619,545, entitled LOOP TIE FOR CONCRETE FORMING PANEL SYSTEMS, filed on Jan. 19, 2018, the contents of which are herein incorporated by reference.

BACKGROUND OF THE INVENTION

Conventional concrete walls may be created by pouring concrete into a suitable concrete form. As is known in the art, concrete foundation walls are generally poured between two sets of concrete forms disposed in essentially parallel relationship and defining therebetween a channel having a dimension for the desired thickness of the concrete wall. Such opposed, spaced apart walls are generally held in a fixed relationship relative to each other against the immense weight of any poured concrete by tie-wires and turnbuckle assemblies having abutment surfaces against which a locking or latching arm on adjacent form sections abut. Once assembled into the shape of the wall, wet concrete is poured into the channel formed between the concrete forms and allowed to dry. The concrete forms typically comprise multiple form panels, which may for example be formed of wood, metal or any other suitable well known material. The height of the form panel may vary by application.

Multiple form panels may be placed side-by-side in order to construct a wall of a desired length. Because the wet poured concrete takes the shape of the forms in which it is placed, the finished concrete wall corresponds in configuration to the assembled form. Therefore, it is important to align precisely the panels composing the concrete form in order to ensure that the finished wall has the desired appearance and strength.

The conventional concrete forming systems often times have difficulty handling wall shapes and configurations that are outside of or different than the standard shapes and sizes of the panels in the forming systems.

SUMMARY OF THE INVENTION

A stacking clip suitable for use with a concrete forming system having one or more frame elements having one or more ribs formed on a rail. The stacking clip allows an extension component, such as a custom panel, to be coupled to the stacking clip and to hence extend the height or the width of the frame element.

The stacking clip of the present invention having one or more frame elements having one or more ribs formed on a rail, comprising a main body having an upper portion and a lower portion, wherein the upper portion is coupled to the lower portion by way of a pair of opposed first and second bent portions. The upper portion has a relatively flat face region having a relatively flat front face, and the lower portion includes first and second foot portions, each of which includes a curved main body having a generally C-shaped configuration. The curved main body includes a first groove formed on an upper portion of the curved main body for seating the rib of the rail; an upper contact region formed on the upper portion of the curved main body adjacent to the first groove and having a contact surface for contacting a top surface of the rail; a second groove disposed on a lower portion of the curved main body; and a lower contact region formed at an end of the lower portion of the curved body for contacting a bottom surface of the rail.

The upper portion of the main body has a plurality of fastener-receiving apertures formed therein. Further, the lower contact region of the first and second foot portions has a finger portion for contacting the bottom surface of the rail and a curved portion adjacent the finger portion.

The first and second bent portions are integrally formed with the upper portion and extend outwardly from a rear surface of the upper portion. The first bent portion is coupled to the upper portion at one end and to the first foot portion at the opposed end, and the second bent portion is coupled to the upper portion at one end and to the second foot portion at the opposed end.

According to one practice, the front face of the upper portion extends in a first plane that is transverse to a second plane encompassing the finger portions of the first and second foot portions, and the first plane is spaced apart from the finger portions in the direction of the second plane.

According to another practice, the first and second bent portions overlie the finger portions of the first and second foot portions.

BRIEF DESCRIPTION OF THE DRAWINGS

These and other features and advantages of the present invention will be more fully understood by reference to the following detailed description in conjunction with the attached drawings in which like reference numerals refer to like elements throughout the different views. The drawings illustrate principals of the invention and, although not to scale, show relative dimensions.

DETAILED DESCRIPTION OF THE INVENTION

Figure 1:
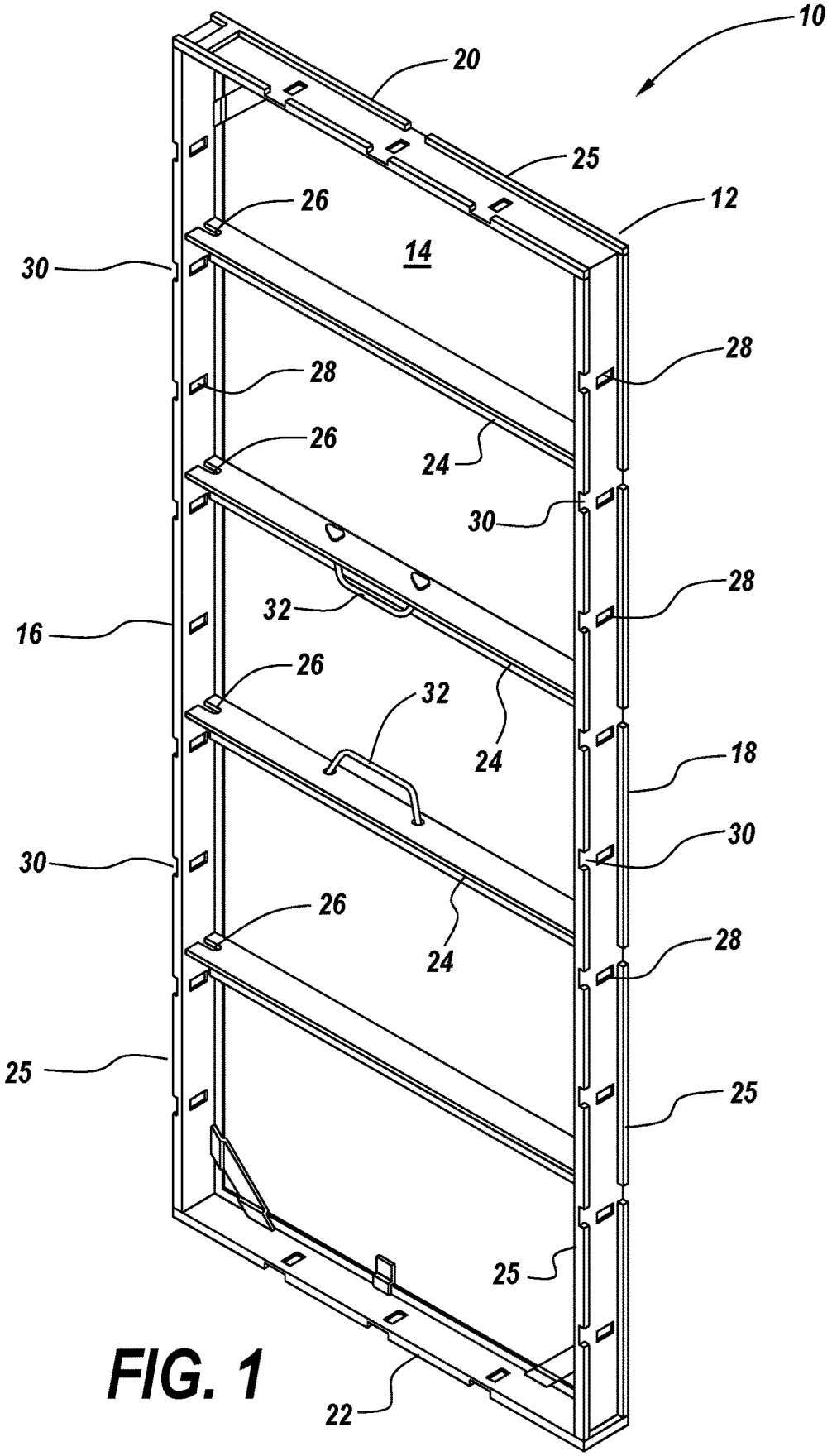
FIG. 1 is a perspective view of a metal, frame based concrete forming system suitable for employing the tie rod of the present invention.
Figure 2:
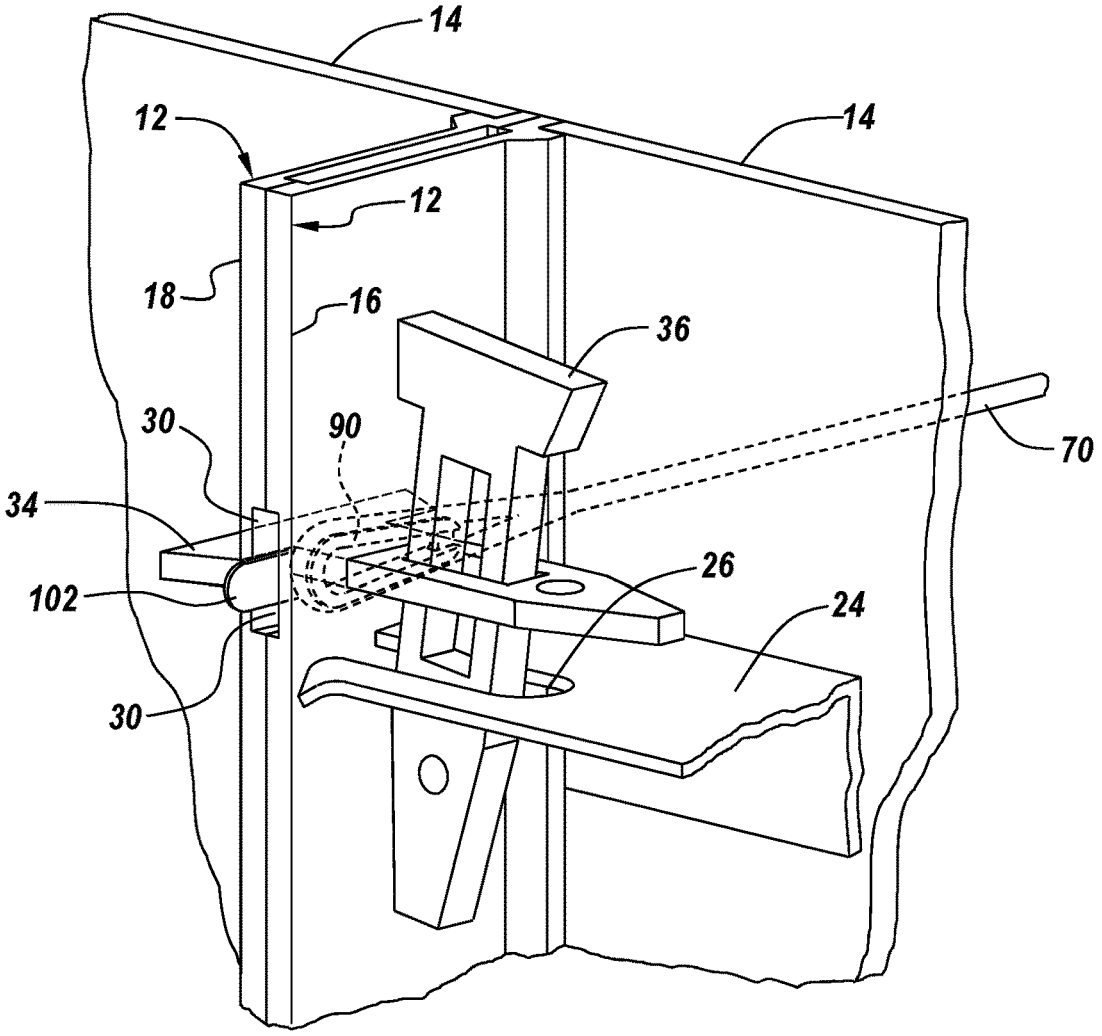
FIG. 2 is partial sectional view of adjacent concrete forming systems employing mounting hardware, such as wedge bolts, and the tie rod of the present invention.
Figure 3:
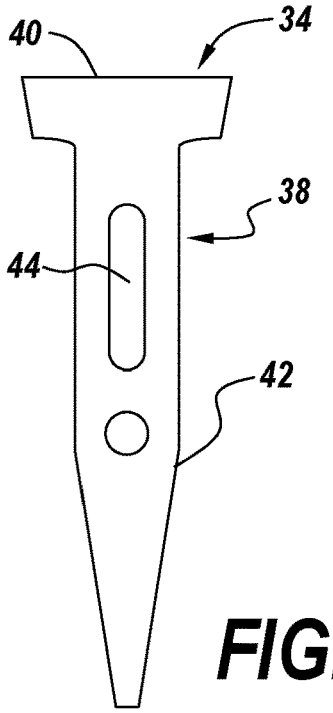
FIG. 3 is a perspective view of the wedge bolt of FIG. 2.

There exists in the art metal, frame-based, panel type concrete forming systems and associated hardware, such as fillers and wedge bolts, for forming concrete walls of any size and shape. An example of a commercially available metal concrete forming system is the Steel-Ply Concrete Forming System from Dayton Superior Corp. The illustrated metal concrete forming system 10 includes a steel frame 12 that can employ a metal or wood facing 14. As shown in FIGS. 1-3, the metal frame or panel 12 has a pair of vertical side rails 16, 18 forming left and right side rails and a pair of horizontal side rails 20, 22 forming the top and bottom rails. Further, a plurality of horizontal cross-members or support rails 24 are formed between the two opposed side rails 16, 18 and help form supports for the frame 12. The cross members 24 also have a cross-member slot 26 formed therein adjacent to the side rails 16, 18. The facing material 14, such as plywood, is attached to one face side of the frame 12. The plywood 14 is typically used to form a smooth finish to the formed concrete wall. The vertical side rails 16, 18 both have side slots 28 formed therein intermittently throughout the length of the side rail. The side slots 28 are adapted to accommodate a securing bolt, such as a wedge bolt, as described further below. Further, the side rails 16, 18, 20, and 22 include a plurality of dado slots 30 formed therein adjacent to the side slots 28. Further, certain cross-members 24 can include a handle 32 formed thereon to assist the user in lifting and manipulating the panel. The side rails 16, 18, 20, 22 also include thereon a series of raised surface features in the form of lips or ribs 25. The ribs 25 can be continuous or can be discrete and non-continuous so as to form the slots 30 therebetween.

The metal form panels 12 can be placed adjacent to each other to form the rough outline of the concrete wall to be formed. As shown in FIGS. 2-3, the adjacent panels 12 can be coupled together and to tie rods or ties 70 disposed within the wall to be formed using a lock-bolt set comprising first and second wedge bolts 34, 36, as is known in the art. In the current embodiment and example, the metal framing system employs loop style tie rods or ties. The first and second wedge bolts 34, 36 can be identical if no filler parts are employed or can be differently configured if a filler part is employed, as is known. As shown, each of the wedge bolts 34, 36 has a main body 38 having a head portion 40 and a wedge shaped body 42 extending therefrom. The wedge shaped body 42 has a bolt slot 44 formed therein.

The dado slots 30, 30 formed in the side rails 16, 18, 20, 22 of the adjacent panels form an enclosure that is adapted to accommodate the protruding end of an associated tie rod 70. The tie rod 70 is used to help strengthen the finished wall that is formed. In metal concrete forming systems, the tie rod 70 can be either a loop tie or a flat tie. Conventional metal loop ties have a main body that has a loop formed at both ends. These types of ties can also be conventionally referred to as panel or S-ties. When positioned correctly between opposed forming panels, the loop ends of the tie are positioned between the dado slots 30 and are aligned with the side slots 28 formed in the side rails 16, 18. The first wedge bolt 34, such as a connecting wedge bolt, is slid into the side slot 28 formed in the side rail 16, 18 and through the loop end of the tie. As such, the tapered end of the first wedge bolt 34 and specifically the bolt slot 44 is exposed. The tapered end 42 of the second wedge bolt 36, such as a clamping wedge bolt, is disposed in the bolt slot 44 and also seats within the cross-member slot 26. The clamping bolt helps connect together the adjacent panels and also helps secure the tie rod 70 thereto.

The tie rod 70 is typically disposed between aligned panels in order to keep the panels properly spaced apart and to ensure that the panels are coupled to each other in a secure manner. The tie rod 70 extends through openings formed in the spaced apart form sections or panels 12 and holds the sections against relative movement toward each other. The tie rods 70 may extend outwardly of the concrete walls and if desired outwardly of the form panels by a selected amount, as is known in the art. Once the concrete is poured between the panel forms and allowed to cure, the portion of the tie rods that extend beyond the concrete walls can be removed.

A problem with conventional tie rods is that they can be relatively difficult to position relative to the metal form panels. Further, the portion of the tie rods that extends beyond the formed and cured concrete wall can be difficult to remove, or when snapped off, typically do not break off cleanly from the rest of the tie rod embedded in the wall. Further, in architectural environments where a clean and relatively unmarked wall is important, the use of conventional metal loop or flat ties presents a problem. Currently, the portion of the ties that extend beyond the wall are snapped off or otherwise removed. This removal process may serve to mar the formed concrete wall. Also, the portion of the tie that remains in the wall can be prone to rusting, and hence at a later time can mar the aesthetics of the finished wall. Further, the ties cannot be used in selected applications, such as sites that require non-magnetic features in the walls, such as medical buildings.

To address these and other issues of conventional metal loop ties, the tie rod 70 of the present invention can be formed of a material other than metal. According to one practice, the tie rod is non-metal, and can be made for example from fibers formed of fiberglass, carbon, and para-aramid synthetic fibers such as Kevlar. The material can be coated, if desired, with one or more other materials. For example, the fiber material can be pre-coated, coated as the fiber is wound about the thimble elements 90, or coated after the tie rod is formed using any suitable material. The coating material can be used to bind the fiber winds together or can be used as a curing or hardening agent. The tie rod 70 of the present invention is illustrated in FIGS. 4-12. The illustrated tie rod 70 is a loop style tie rod, although other forms and configurations can be employed consistent with the teachings of the present invention. As shown for example in FIGS. 4-9, the illustrated loop tie rod 70 of the present invention has a main body 72 with a central linear region 74 and has loops 76, 78 formed at opposed ends. The loops 76, 78 can be sized, if desired, to house a reinforcing element, such as thimble element 90. According to an alternate embodiment, the illustrated loop tie rod 70 does not include the thimble element 90. The loop tie rod 70 is preferably formed from a fiberglass material that can be, if desired, coated with a select material, such as a binding material. According to one embodiment, the fiberglass can be pre-coated or coated with any suitable curing or hardening material, such as with an epoxy resin material, such as that commercially available from TCR Composites, USA. The fiberglass is preferably a high strength glass fiber, although other strength types can be used. The fiberglass tie rod of the present invention has low thermal conductivity, and has a thermal expansion coefficient similar to concrete, thus creating a better bond between the tie and concrete, which serves to improve the overall water sealing capability of the tie. The fibers employed in the present invention, such as the fiberglass fibers, exhibit a tensile strength of between about 300K PSI and about 530K PSI. The finished and cured tie rod 70 preferably exhibits a tensile strength of around 6000 PSI. A key feature of the present invention is that the strength of the resultant fiberglass tie rod 70, in use, is able to significantly match the strength of conventional metal loop ties.

Figure 9:
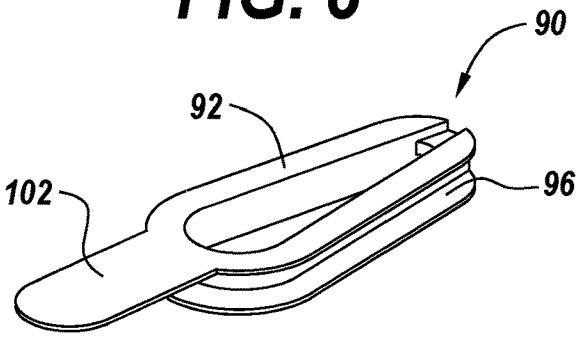
FIG. 9 is a perspective view of the thimble portion of the tie rod of the present invention illustrating the tab portion of the thimble.

The illustrated thimble element 90 has a main body 92 that is shaped in a manner similar to a horse-shoe shape that can have an open or closed end, and preferably has a closed end. The outer peripheral or circumferential edge or surface 94 of the main body has a central channel 96 formed therein. The channel preferably has a thickness or width of between about 0.175 inches and about 0.22 inches, and preferably has a width of about 0.20 inches. The inner surface 98 of the main body has an optional raised edge-like protrusion 100 that forms a fin feature or element. In an alternate embodiment, as shown in FIG. 9, the thimble 90 can include a tab-like protrusion 102 that extends outwardly from the outer surface 94 of the main body 92. According to another practice, the floor of the central channel 96 can have a low friction coating or material applied thereto. For example, the channel can be coated with a polytetrafluoroethylene (PTFE) material or with a polytetrafluoroethylene (PTFE) tape so as to reduce the frictional forces of the thimble 90. Further, the coating also serves to increase the overall strength of the tie rod 70. Alternatively, the thimble main body can be coated with any suitable material, such as with a tin-based material or PTFE. The thimble element 90 of the present invention can be made from any suitable material, including from metal materials, such as from zinc-based alloys (e.g., Zamak 3), steel, aluminum, magnesium alloy, carbon fiber, polytetrafluoroethylene (PTFE), or plastic, or from combinations of these materials.

Figure 4:
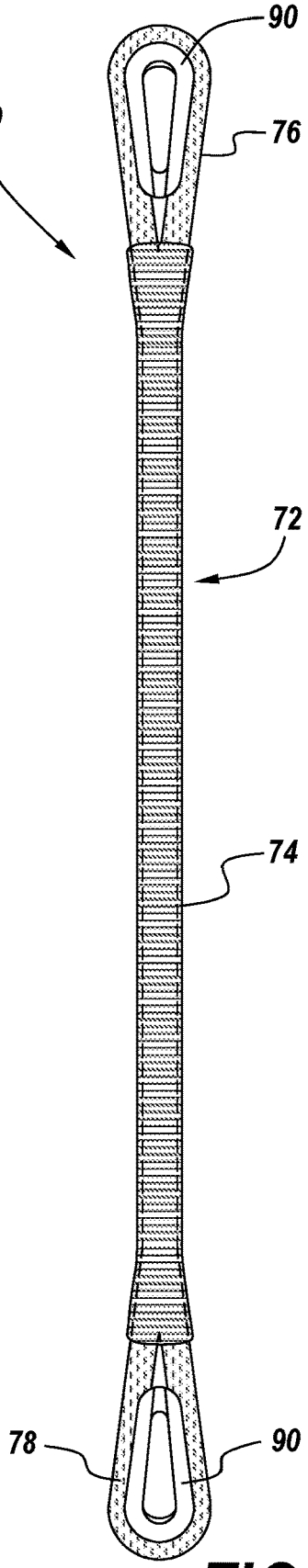
FIG. 4 is a perspective view of the tie rod of the present invention.
Figure 5:
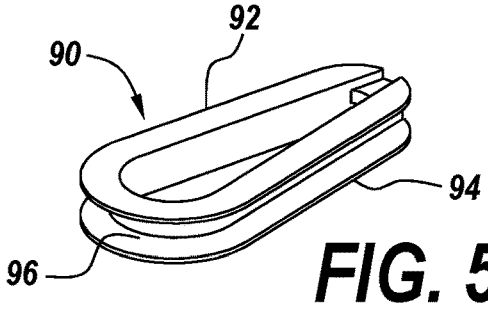
FIGS. 5 and 6 are perspective views of the thimble portion of the tie rod of the present invention.
Figure 6:
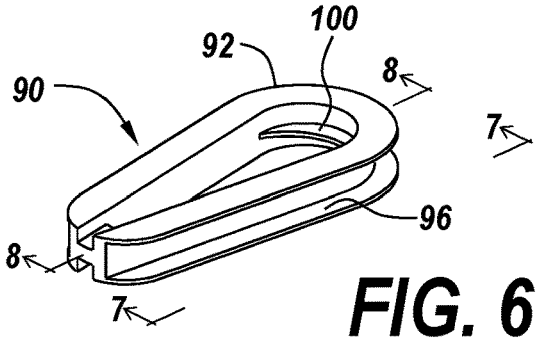
Figure 7:
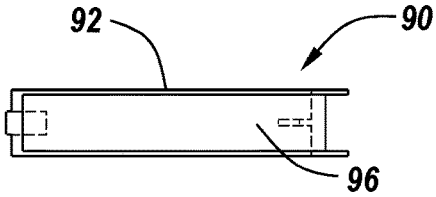
FIG. 7 is a cross-sectional view of the thimble portion of the tie rod of the present invention along line 7-7 of FIG. 6.
Figure 8:
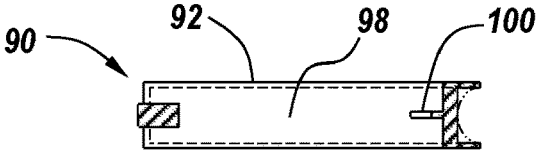
FIG. 8 is a cross-sectional view of the thimble portion of the tie rod of the present invention along line 8-8 of FIG. 6.
Figure 10:
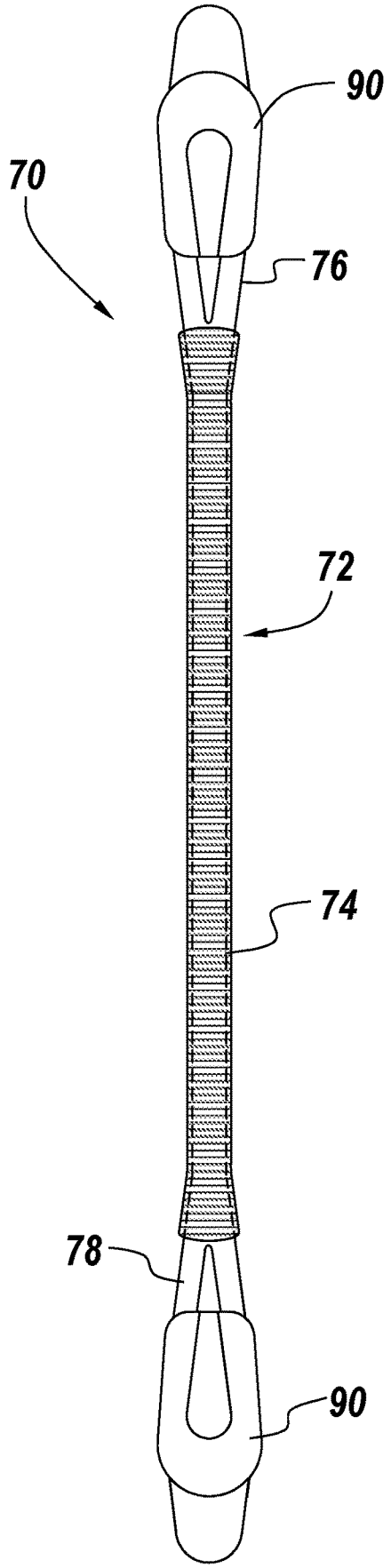
FIG. 10 is a perspective view of the tie rod of the present invention.
Figure 13A:
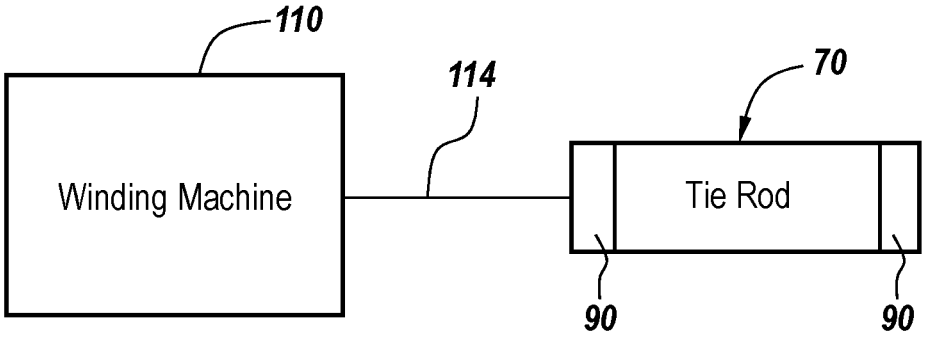
FIG. 13A is a schematic block diagram illustrating the winding machine employed for winding the fiber to create the tie rod of the present invention.
Figure 13B:
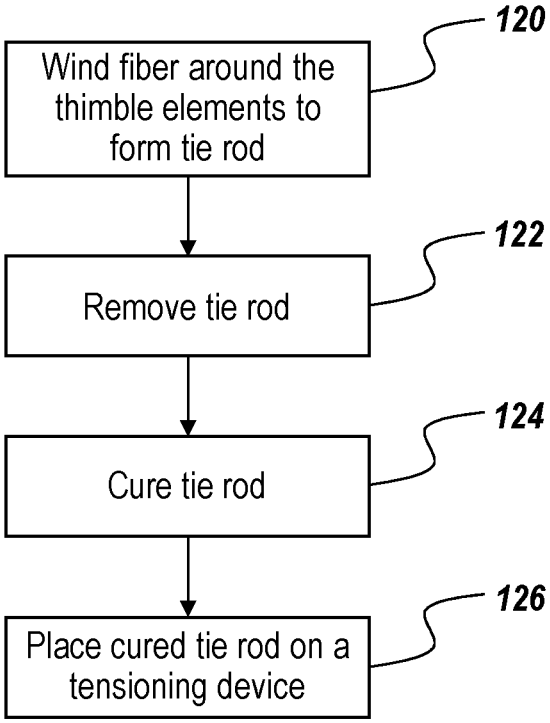
FIG. 13B is a flowchart diagram illustrating the steps for forming the tie rod of the present invention.

The illustrated loop tie rod 70 of the present invention can be formed by winding the fiber 114 (e.g., fiberglass material) using any suitable fiber or filament winding machine 110 about the opposed thimble elements 90. For example, as shown in FIGS. 13A and 13B, the loop tie rod 70 has associated therewith the thimble elements 90, 90. The illustrated fiber 114 can be wound about the thimble elements 90, 90 by the winding machine according to known techniques, step 120. For example, the tie rod 70 can be placed on or coupled to a rotating and/or translational mandrel or support (not shown) and the fiber can be wound, under tension, between the opposed thimble elements. Alternatively, the fiber winding machine 110 can be rotated about the tie rod. The loop tie rod 70 thus includes one or more continuous glass fibers that are wound into the desired shape of the loop tie. When the continuous fiber is wound about the thimbles 90, 90, the fibers are preferably maintained under tension, such as between about 2 lbs and about 10 lbs pressure, and the overwrap tension on the fiber when wound to create the overwrap is between about 5 lbs pressure and about 20 lbs pressure. The fiber is wound about the thimble elements a selected number of times ranging between about 8 times and about 35 times, depending upon the size and yield of the fiber. The fibers are wound between the thimbles until the channel 96 is filled with the fibers. Upon completion, the tie rod can be completed by optionally continuing to wind the fiber to create an optional overwrap in the central region 74 of the tie. As is shown, the number of wraps of the fiber between the thimble elements 90, 90 can be specified such that the fiber fills the channel 96 of the thimble element without extending beyond the confines of the channel. Optionally, the fiber can be wound further until the fiber extends past the confines of the channel 96, as shown in FIG. 4. Alternatively, as shown in FIG. 10, the fiber can wound about the thimbles 90 so as to fill the channel 96 without exceeding the channel height or depth.

The completed loop tie 70 is then removed from the supporting structure, step 122, and then cured by heating by placing the loop tie in any suitable heating device for a selected duration of time and at a selected temperature, step 124. For example, according to one embodiment, the loop tie is cured by being placed in a heating oven for about 1 to about 2 hours, at a temperature of about 250° F. to about 300° F., based on the type of material used. Those of ordinary skill will readily recognize that the time and temperature can vary as a function of the material type used to form the tie. Those of ordinary skill will also recognize that UV-based epoxy resins can also be used, and hence can be cured using UV radiation rather than heat. Once completed, the finished tie can be placed on a tensioning device or frame (not shown) which keeps the cured loop tie under tension so as to align and equalize the fibers for any suitable amount of time, step 126.

The illustrated tab portion 102 of the thimble 90 can help guide the tie rod 70 through the dado slots 30 formed in the form panels 12 when the panels are assembled. Further, the tab portion 102 can provide a visual indication or confirmation that a tie rod 70 is indeed in place when the panels are all assembled, since it projects outwardly beyond the panels on the outside of the wall. Without the tab portion 102, there is no quick and easy way to visually confirm that a tie rod 70 was not missed when installing the panel forms. Those of ordinary skill will readily recognize that not all types of ties, including loop ties, are designed to provide an end portion that will readily pass through the panel forms and extend therebeyond to allow visual confirmation of placement. Thus, the tab extension 102 allows the fiberglass tie rod of the present invention to easily pass through the forms (e.g., the dado slots) and extend past the forms so as to easily viewable by the user.

Figure 11:
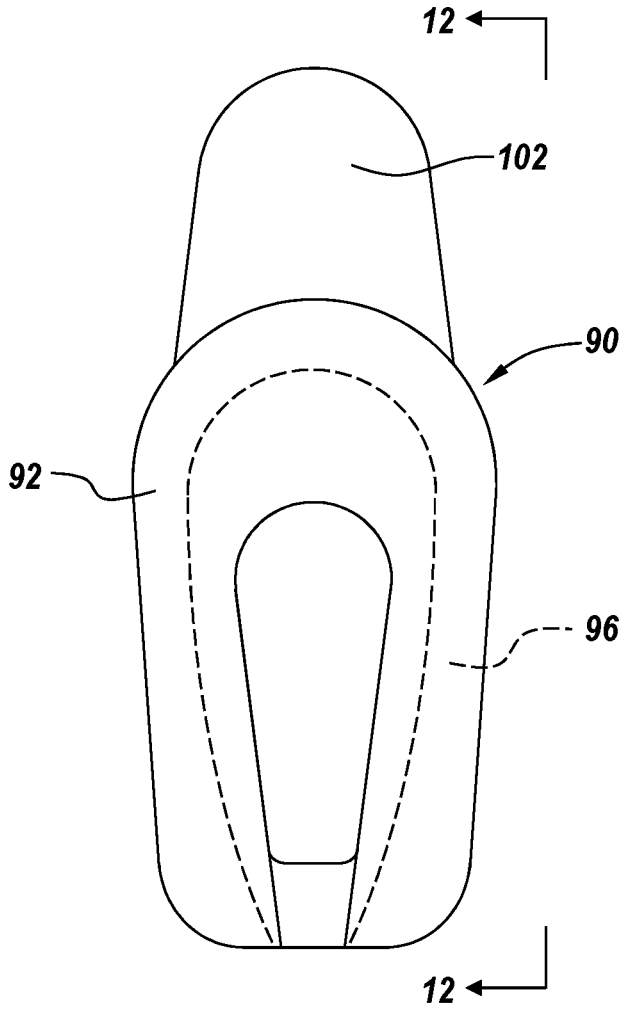
FIG. 11 is a front view of another embodiment of the thimble element of the present invention.
Figure 12:
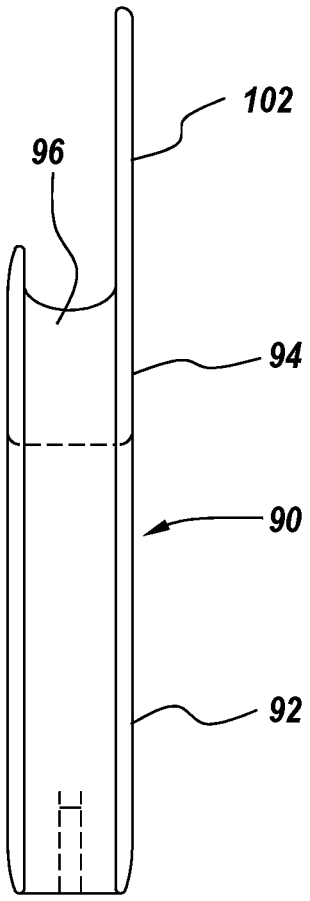
FIG. 12 is a side view of the thimble element of FIG. 11.

Further, the optional ridge or fin element 100 formed along the inner surface 98 of the main body 92 is adapted to bear against the wedge bolt 34, 36 that engages it when assembled in the panel system. The fin element 100 is sized and shaped such that it can deform, that is, give way under load, in a predictable way, manner and rate. In doing so, the fin element 100 allows the tie rod 70 to effectively lengthen to a limited extent, which aids in equalizing the load shared with neighboring tie rods, so that slight variations in length of the tie rods do not subject the shortest tie rod in a group to unwanted and undesirable stresses. Further, the fin element 100 is a visual indicator and can act as forensic evidence of overloading of the tie rod ends of the tie rod 70 in the event of a blowout of the wall when pouring. According to an alternate embodiment, as shown in FIGS. 10-12, the thimble element 90 can be free of the fin element 100 and the main body portion 92 of the thimble element that contacts the wedge bolts 34, 36 or other panel elements can deform at the point of contact, which is usually where the inner portion of the thimble element contacts the wedge bolts in an axial direction. This deformation of the tie rod main body also serves to effectively lengthen the overall length of the tie rod to a limited extent. Further, the tie rod 70 of the present invention can be configured to work with plywood form panel systems, such as Resi-Ply concrete forming systems, and aluminum form panel systems.

Figure 14:
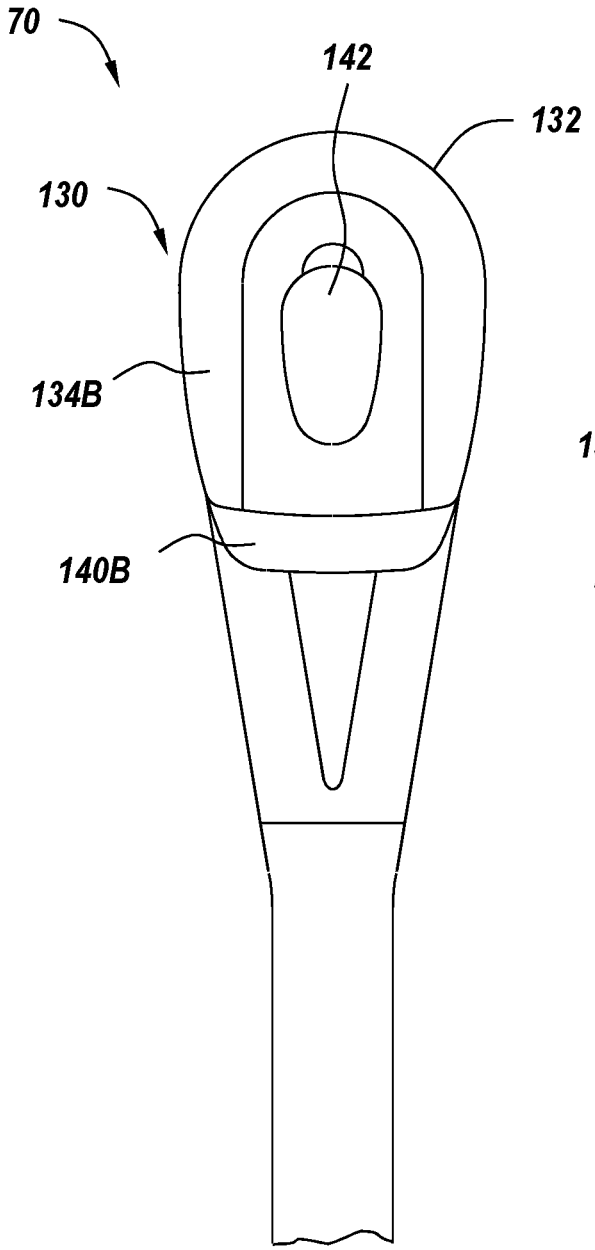
FIG. 14 is a perspective view of another embodiment of the thimble element of the tie rod of the present invention.
Figure 15:
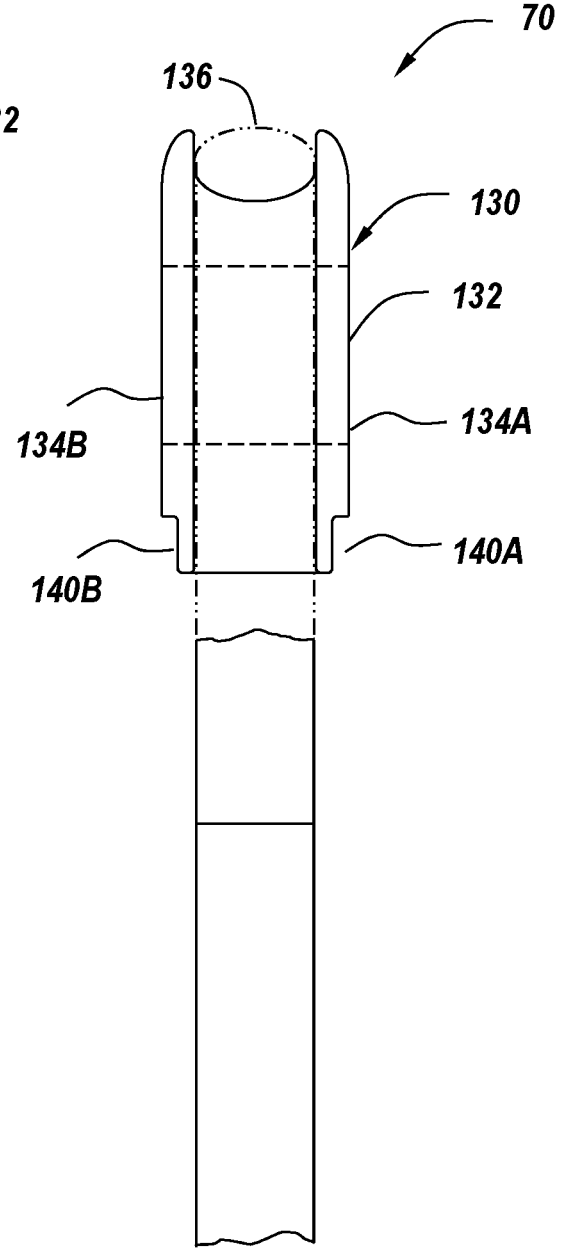
FIG. 15 is a side view of the thimble element of FIG. 14.

The present invention also contemplates the use of tie rods 70 employing differently shaped and configured thimble elements. For example, an alternate embodiment of the tie rod 70 of the present invention is illustrated in FIGS. 14 and 15. Like reference numerals are used throughout to indicate similar or identical structure. According to another embodiment of the invention, the tie rod 70 of the invention can include a pair of opposed thimble elements 130 (only one is shown) that has a main body 132 having a generally horse-shoe shape with a closed end that has a pair of opposed outer surfaces 134A, 134B. The main body 132 forms a central opening 142 that is sized and configured for seating one of the wedge bolts 34, 36. The opposed outer surfaces 134A, 134B have a central channel 136 formed in a peripheral or outer surface of the main body. In addition to the central channel 136, each of the outer surfaces 134A, 134B can have an outer channel 140A, 140B, respectively, formed therein. The outer grooves 140A, 140B are sized and configured for mounting or seating a swing latch element of conventional concrete forming systems, such as the STEEL DOG® form systems commercially available from Titcomb Bros. Mfg.

Figure 16:
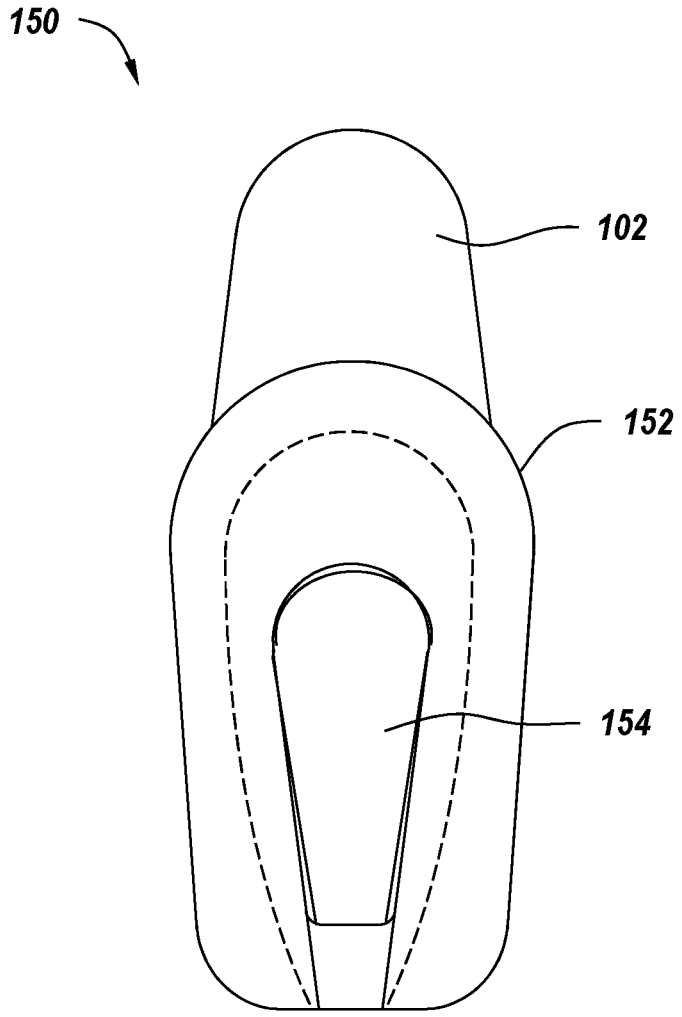
FIG. 16 is a perspective view of yet another embodiment of the thimble element according to the teachings of the present invention.
Figure 17:
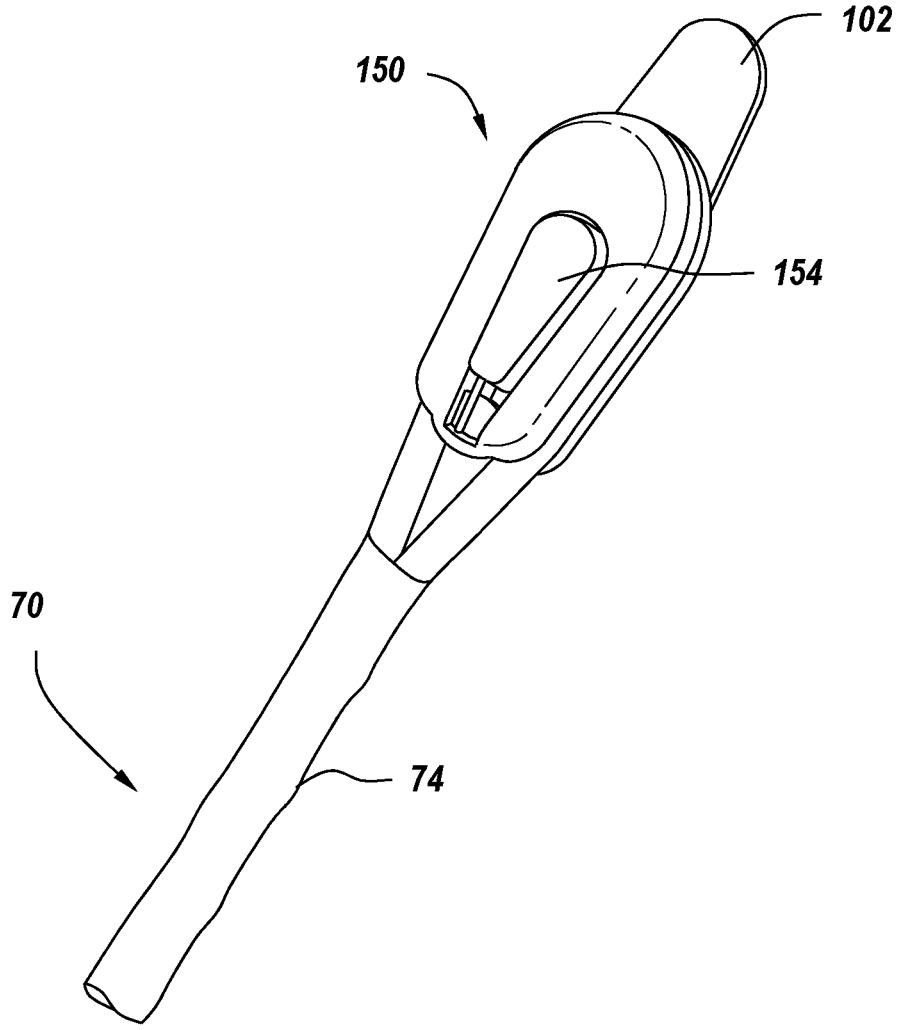
FIG. 17 is a perspective view of the thimble element of FIG. 16 as part of the tie rod according to the teachings of the present invention.
Figure 18:
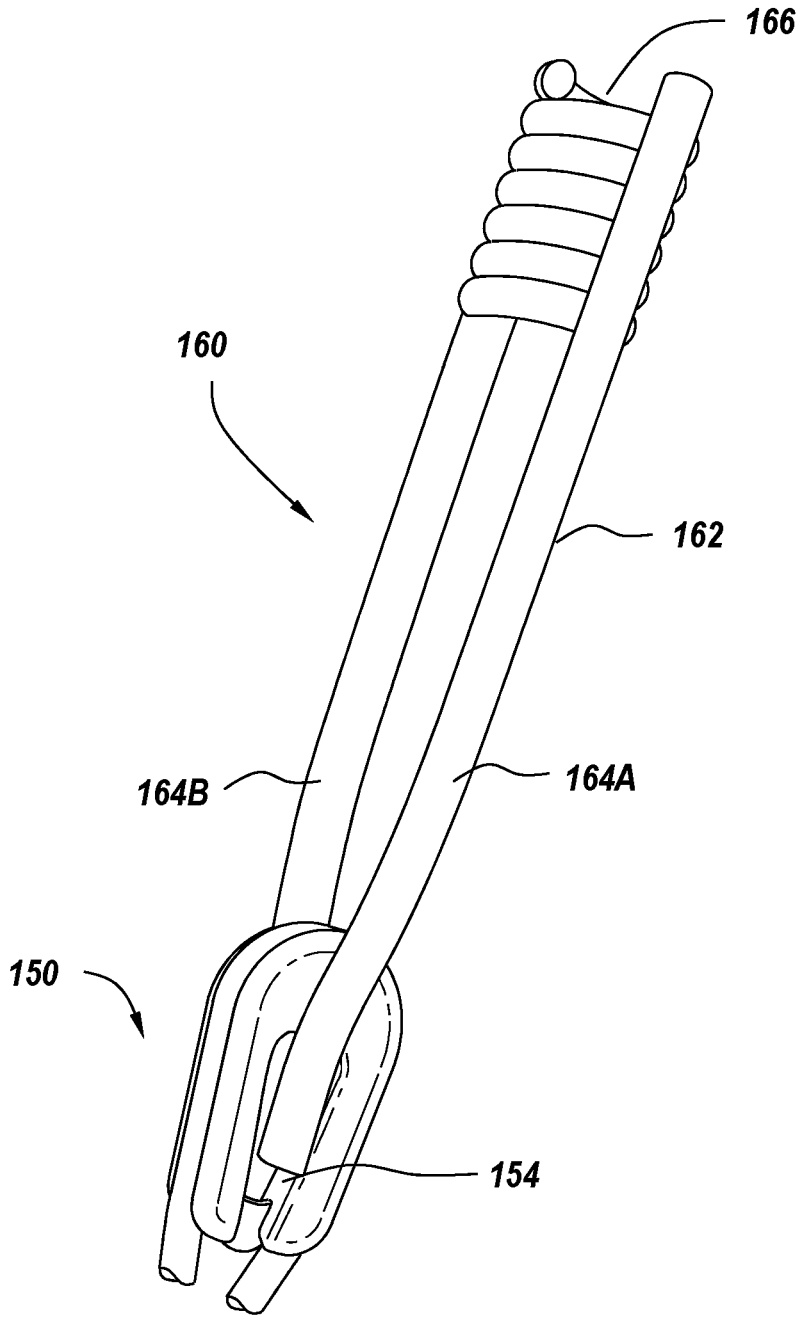
FIG. 18 is a perspective view of the thimble element of FIG. 16 as part of the tie rod and attached to transition hardware according to the teachings of the present invention.
Figure 19:
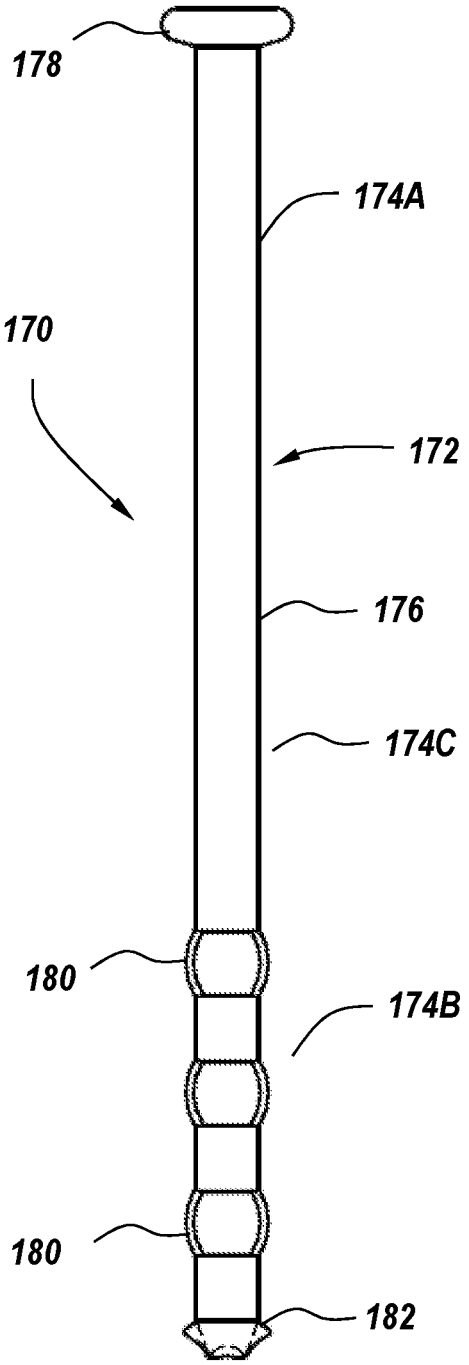
FIG. 19 is a top view of a button rod element suitable for use with the tie rod according to the teachings of the present invention.
Figure 20:
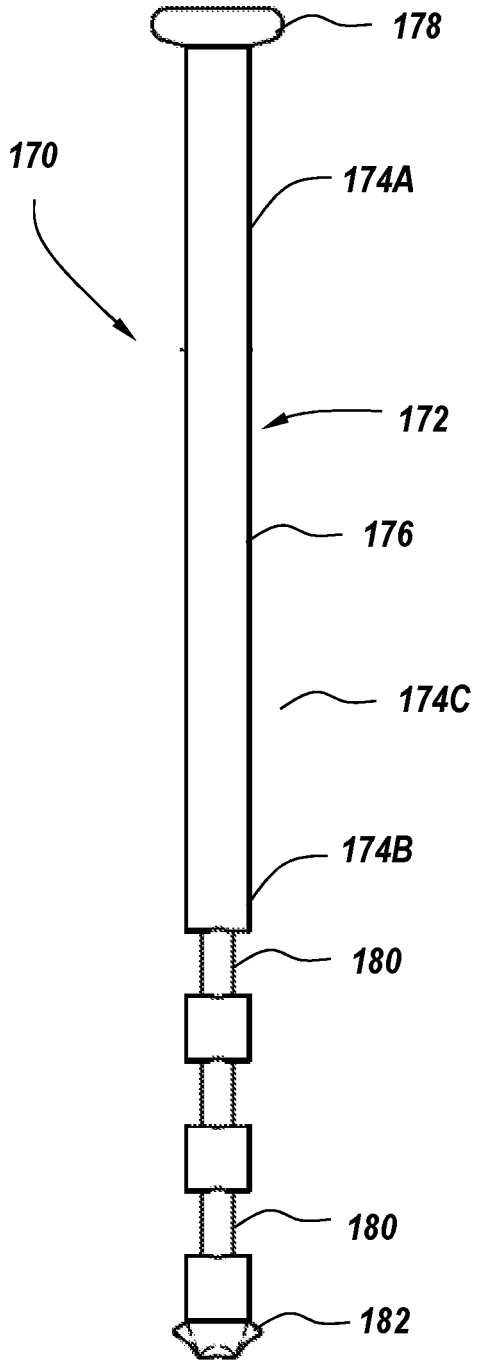
FIG. 20 is a side view of the button rod element of FIG. 19 suitable for use with the tie rod of the present invention.
Figure 21:
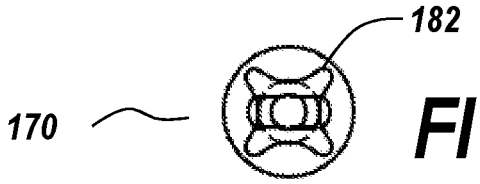
FIG. 21 is an end view of the button rod element of FIG. 19 suitable for use with the tie rod of the present invention.
Figure 22:
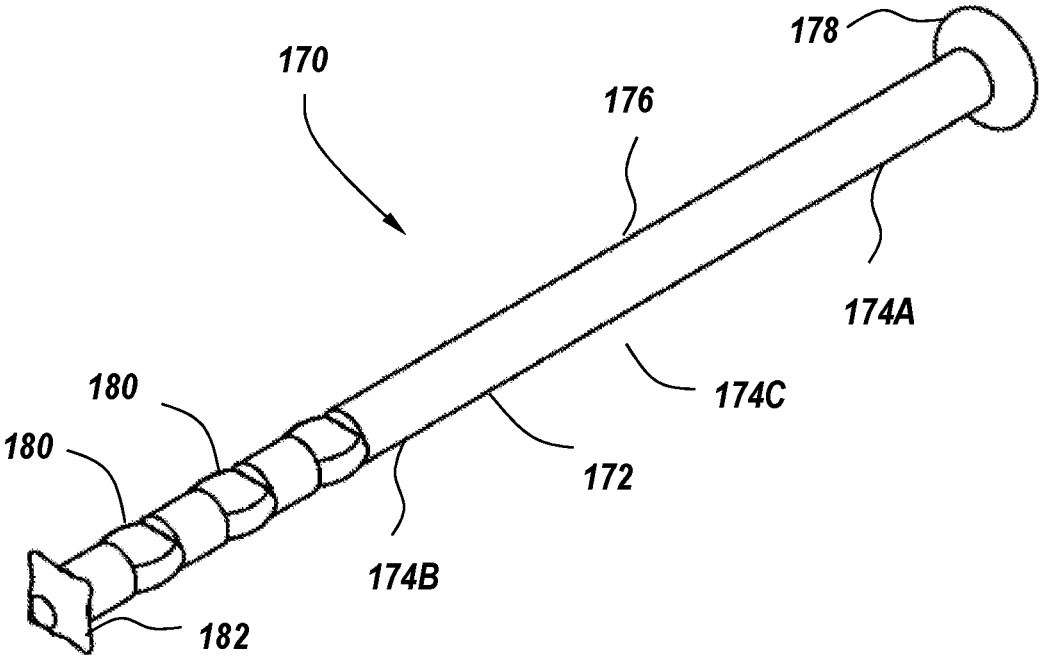
FIG. 22 is a perspective view of the button rod element of FIG. 19 suitable for use with the tie rod of the present invention.
Figure 23:
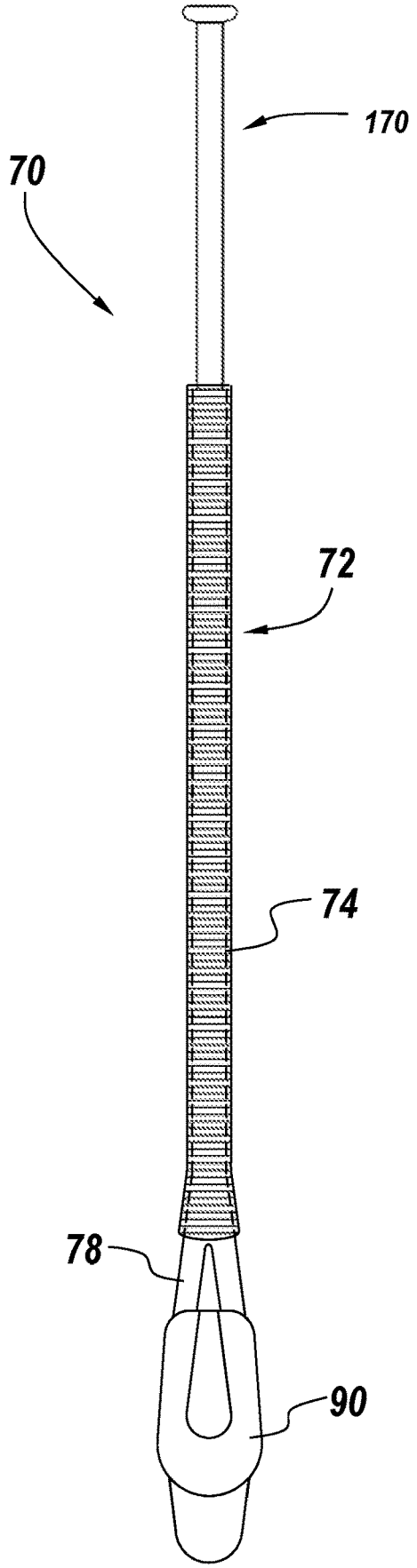
FIG. 23 is a perspective view of the tie rod of the present invention employing different types of structure at the end regions, including for example a thimble element and a button rod element, according to the teachings of the present invention.
Figure 24:
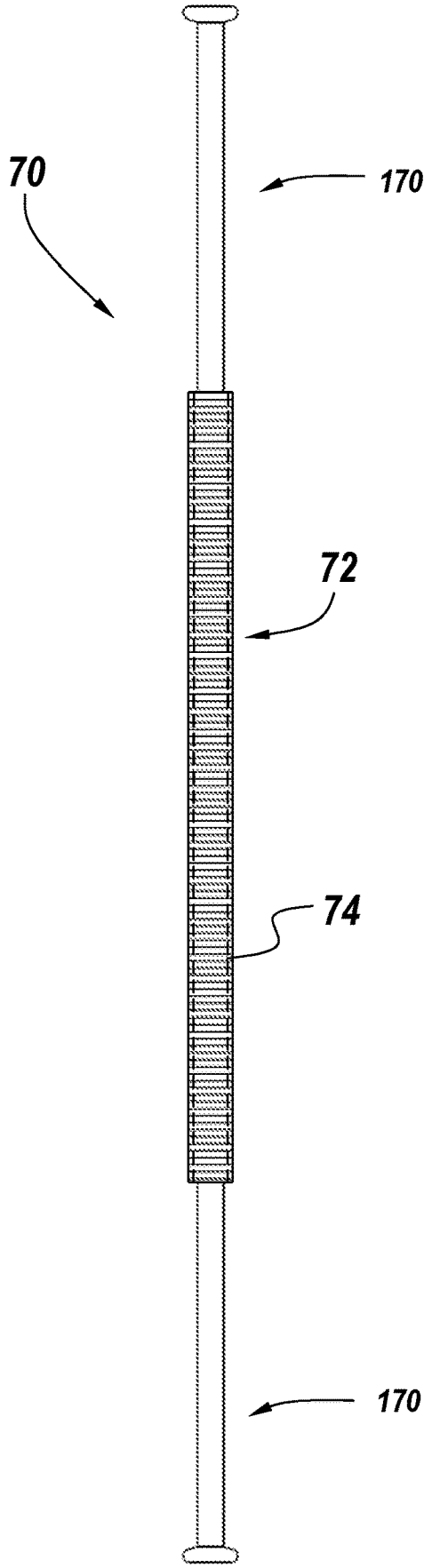
FIG. 24 is a perspective view of the tie rod of the present invention employing button rod elements at the end regions according to the teachings of the present invention.
Figure 25:
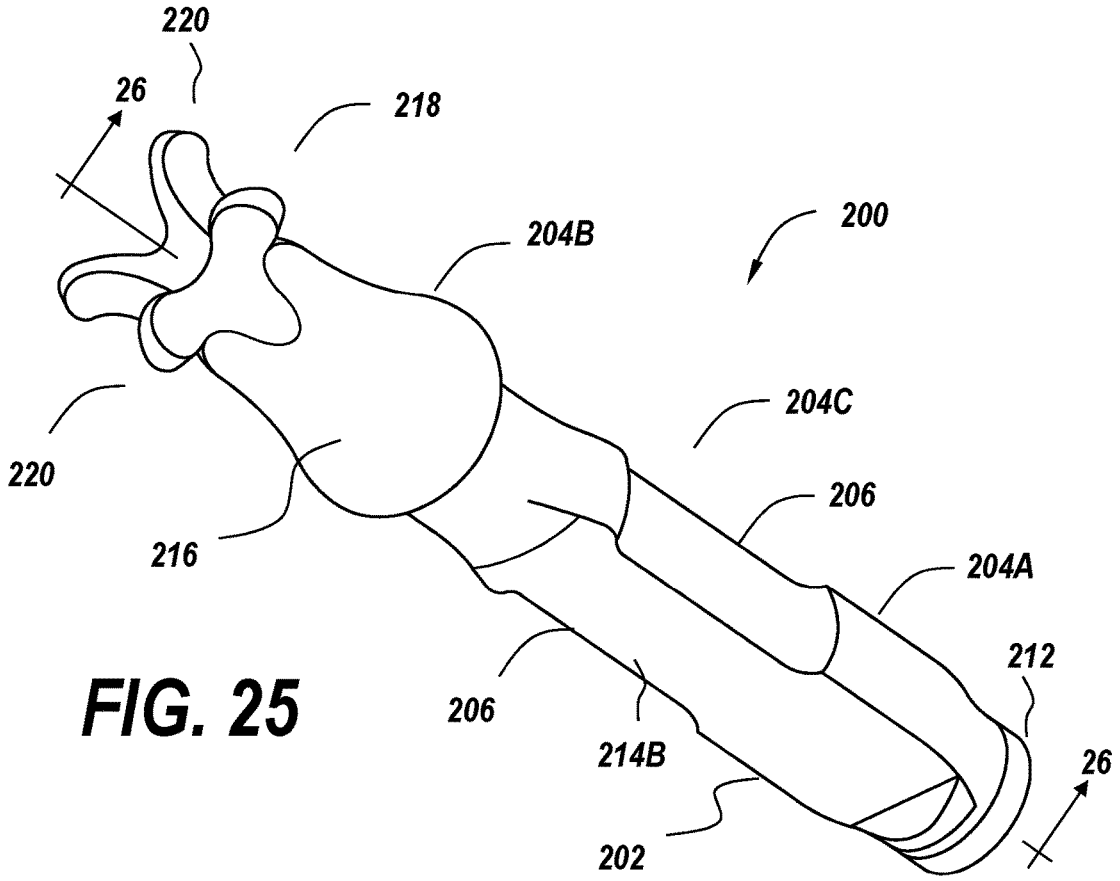
FIG. 25 is a perspective view of another embodiment of the button rod element suitable for use with the tie rod of the present invention.
Figure 26:
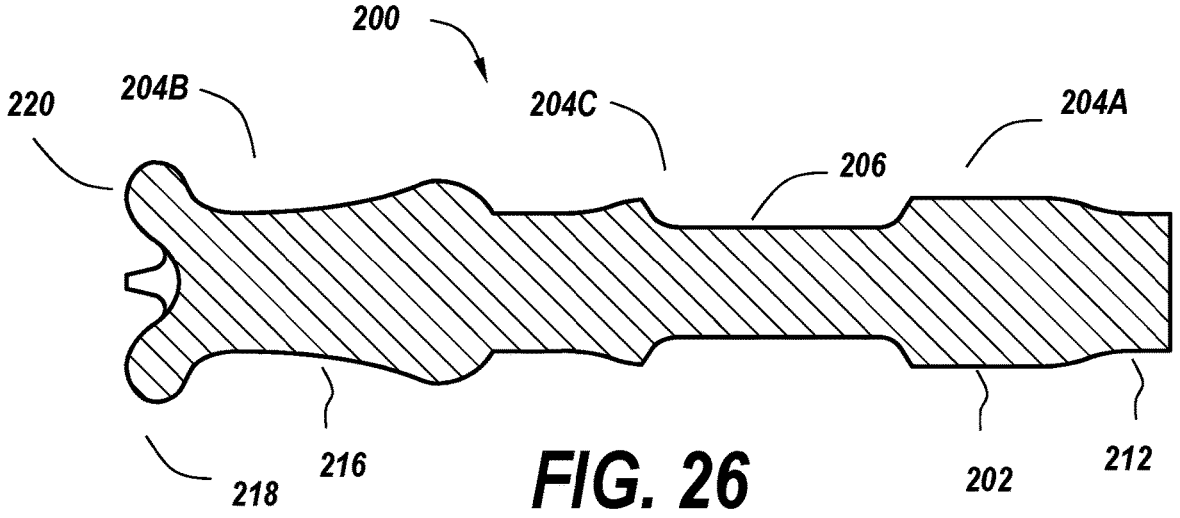
FIG. 26 is a cross-sectional view of the button rod element of FIG. 25 taken along line 26-26 according to the teachings of the present invention.
Figure 27:
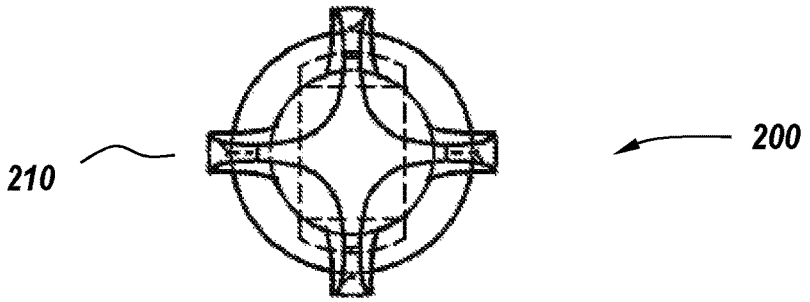
FIG. 27 is an end view of the button rod element of FIG. 25 according to the teachings of the present invention.
Figure 28:
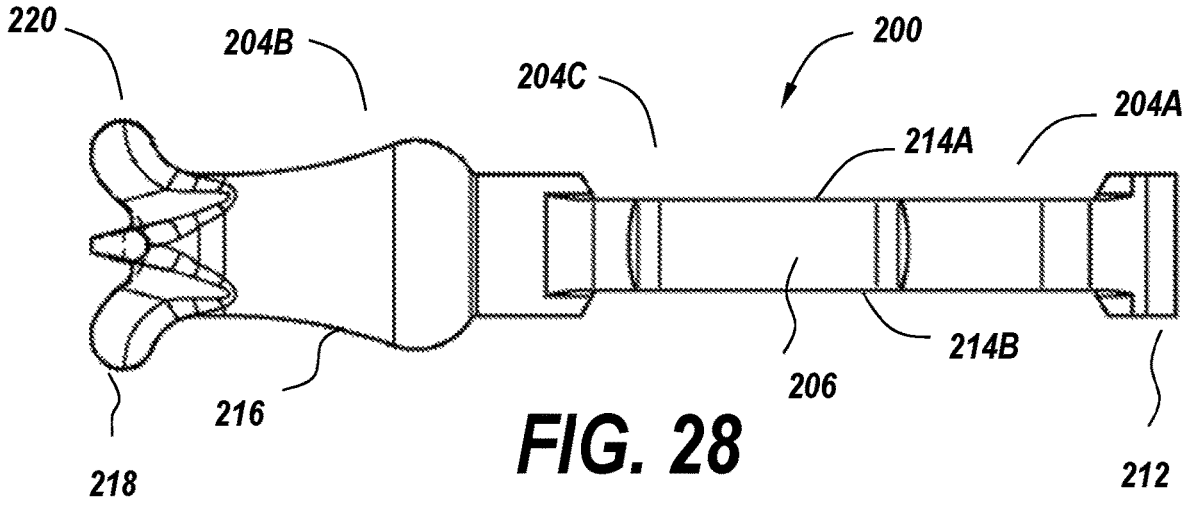
FIG. 28 is a side view of the button rod element of FIG. 25 according to the teachings of the present invention.
Figure 29:
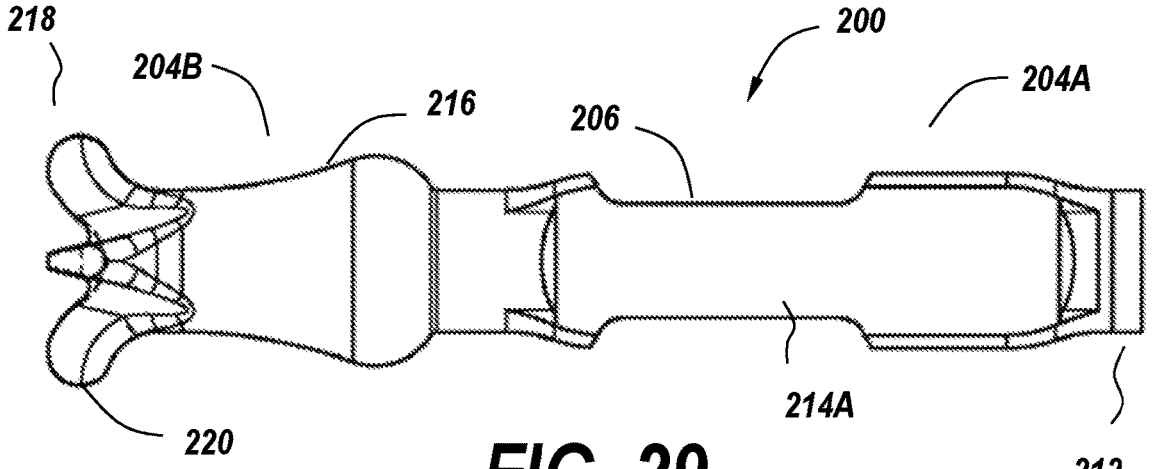
FIG. 29 is a top view of the button rod element of FIG. 25 according to the teachings of the present invention.
Figure 30:
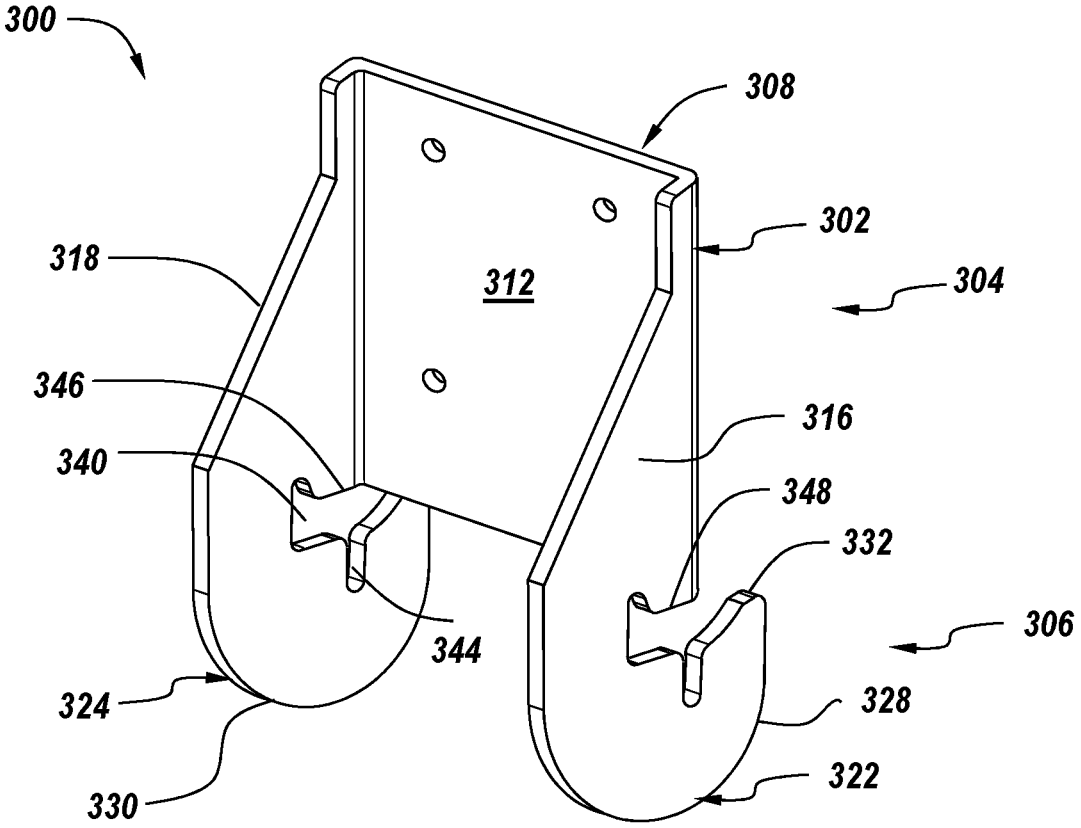
FIG. 30 is a perspective view of a first embodiment of a stacking clip according to the teachings of the present invention.
Figure 31:
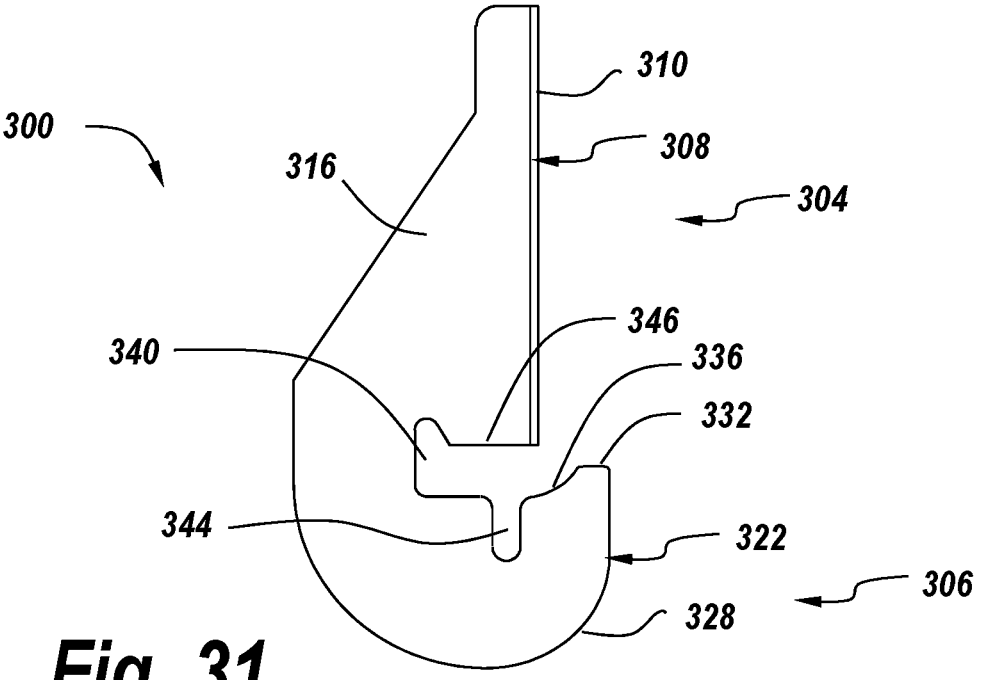
FIG. 31 is a side view of the stacking clip of FIG. 30.
Figure 32:
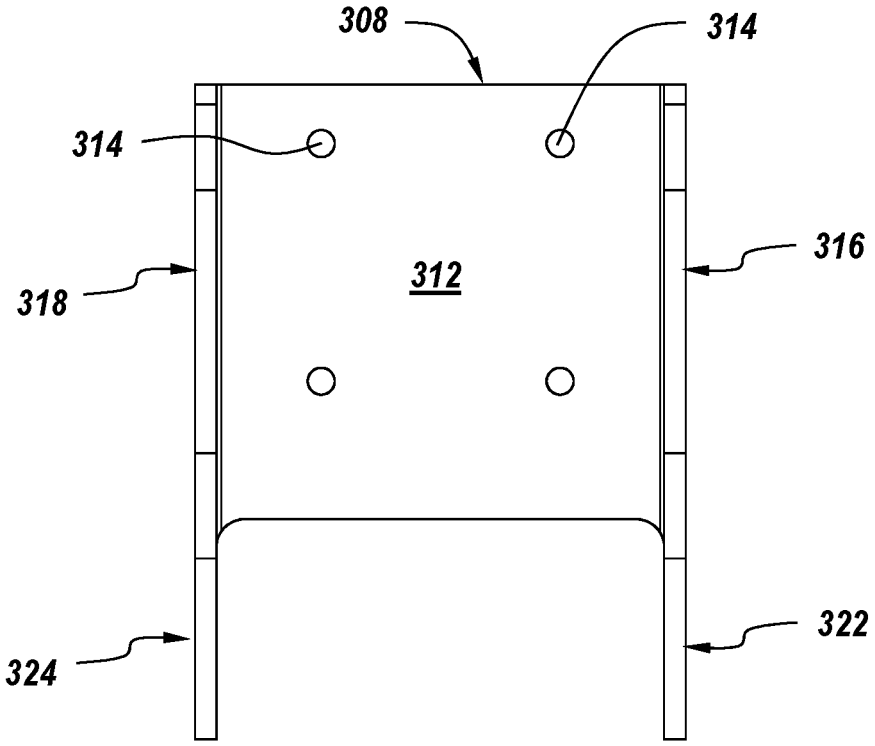
FIG. 32 is rear view of the stacking clip of FIG. 30.
Figure 33:
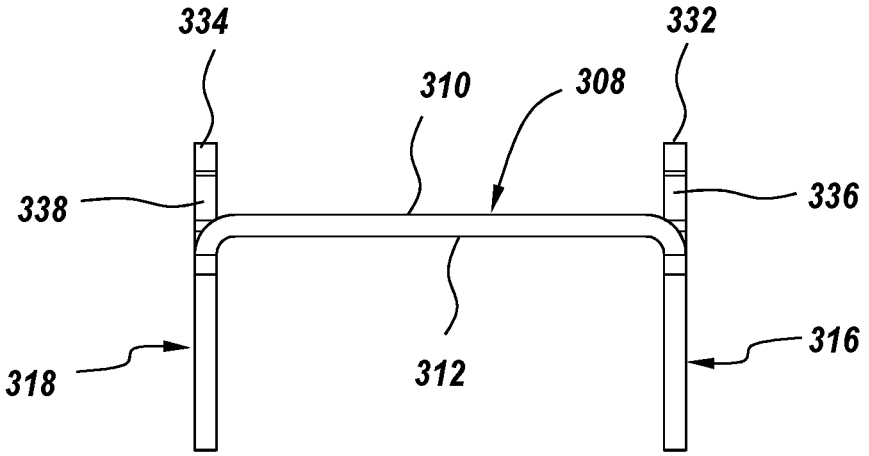
FIG. 33 is a top view of the stacking clip of FIG. 30.

FIGS. 16-18 illustrate yet another embodiment of the thimble element of the present invention. Like reference numerals are used throughout to indicate similar or identical structure. The illustrated thimble element 150 includes a main body 152 having a tab portion 102 formed thereon and which extends outwardly from the main body 152. The main body 152 can have a central opening, similar to thimble elements 70, 130, or can have a solid component 154 that fills the opening, as illustrated. The solid component 154 can be secured within the thimble 150 according to known techniques. Alternatively, the solid component 154 can be integrally formed with the main body 152 of the thimble element 150. The solid element 154 can be used to secure one or more types of transition hardware to the thimble element, and hence to the tie rod 150. For example, a coil tie element 160 can be secured or coupled to the tie rod 70 by way of the solid component 154. The illustrated coil tie 160 includes a main body 162 that has a pair of opposed leg portions 164A, 164B having a bottom portion that are attached to the solid component 154 according to known techniques, such as for example by welding. An example of a suitable coil tie are the STEEL DOG® coil ties commercially available from Titcomb Bros. Mfg. The top portion of the leg portions 164A, 164B are flared outwardly and are attached to an elongated coil element 166. The coil element 166 can be coupled or secured to other types of hardware, as is known in the art. For example, the coil element 166 can be coupled to tie rods by way of the wound fiber such as fiberglass, according to the above techniques.

The tie rod 70 of the present invention can also include at the opposed ends other types of hardware components in addition to or instead of the thimble elements. For example, as shown in FIGS. 19-24, the tie rod can employ button rods 170 at one or more of the opposed ends of the tie rod 70. The illustrated button rods 170 has an elongated main body 172 that has a top end region 174A, an opposed bottom end region 174B, and intermediate region 174C. The main body has a main shaft 176 that has a head portion 178 formed at the top end region 174A. The bottom end region 174B of the main shaft 176 includes a chamfered region that has a plurality of alternating spaced apart cut-outs 180 that are flattened in a selected plane. Specifically, the cut-outs are spaced apart along the main axis of the rod element. The bottom end region 174B has an anchor portion that is formed as a star pointed end 182, which serves as an anchor point.

The fiber can be wound about the chamfered region and specifically about the cut-outs 180 and the star pointed end 182 so as to bind to the main shaft 176, according to known techniques. For example, the fiber can be wound about the button rod 170 using the winding machine 110 and by rotating the button rod so as to expose alternating cut-outs 180 and alternating portions of the star pointed end 182. The tie rod 70 of the present invention can employ a button rod 170 at one end and a thimble element at the other end, FIG. 23, or can employ the button rod 170 at both ends, FIG. 24.

FIGS. 25-29 illustrate another embodiment of the button rod element 200 of the present invention. The illustrated button rod 200 has a generally elongated main body 202 that has a first or top end region 204A, a second or bottom end region 204B, as well as an intermediate region 204C. The top end region 204A includes a head element 212. The intermediate region 204C includes a pair of spaced apart cut-outs 206, 206 formed in side surfaces thereof, and has relatively flat top and bottom surfaces 214A and 214B, respectively. The cut-outs are preferably radially spaced apart relative to a width of the main body. The bottom end region 204B includes a rose-hip section that has a relatively bulbous portion 216 that tapers to an end portion and terminates in a flared section 218 having a plurality of flared legs 220 that form anchor portion. The fiber can be wound about the intermediate region 204C and/or the bottom end region 204B, and specifically about the cut-outs 206 and the flared legs 220 of the flared section 218 so as to bind to the main body 202, according to known techniques. For example, the fiber can be wound about the button rod 200 using the winding machine 110 and by rotating the button rod so as to expose alternating cut-outs 206 and alternating legs 220 of the flared section 218. The tie rod 70 of the present invention can employ one or more of the thimble elements 90, 130, 150, the button rod 170, or the button rod 200, or any combination thereof.

As is known in the art, when building foundation walls and the like, the configuration of the walls may require that a section be formed that is different in size and configuration than the standard panel size. As such, a custom panel 350 may need to added to the side of an existing form frame or panel 12 or on top of an existing form frame or panel 12. The custom panel 350 can generally be formed of plywood of varying thickness depending upon the specific wall being formed. The custom panel can be manufactured or cut in the field, and hence needs to be coupled or secured to one or more form panels 12.

The present invention is directed to the use of one or more stacking clips 300 that can be coupled to one or more metal frames or panels 12 and secured or coupled to the custom plywood panel 350. A first embodiment of the stacking clip 300 of the present invention is illustrated in FIGS. 30-34. The illustrated stacking clip 300 has a main body 302 having an upper portion 304 and a lower portion 306. The upper portion 304 functions as a custom panel support region for securing the custom panel thereto. The upper portion 304 has a relatively flat face region 308 having a relatively flat front surface or face 310 and a relatively flat rear surface or face 312. The face region 308 also includes a plurality of fastener receiving apertures 314 formed therein. The apertures are sized and configured to receive one or more known fasteners, such as nails or screws, for securing the custom panel to the face region 308.

The bottom portion 306 of the stacking clip 300 is coupled to the upper portion 304 by way of a pair of opposed flange or bent portions 316, 318. The size or thickness of the bent portions dictates the space or separation between front most portion of the lower portion 306 and the front face 310 of the face region 308. The separation or distance between these two portions dictates the thickness of the custom plywood panel that can be secured to the stacking clip 300. The bent portions 316, 318 are integrally formed with the upper portion 304 and extend outwardly from the rear face 312 thereof.

The lower portion 306 of the stacking clip 300 includes a pair of spaced apart foot portions 322, 324. Each of the foot portions 322, 324 includes a curved main body 328, 330, respectively. Each of the curved main bodies 328, 330 has a generally C-shaped configuration and is integrally formed with the bent portions 316, 318 at one end and terminates at an opposed end in a contact portion or region. Each of the contact regions of the foot portions includes a finger portion 332, 334 that transitions to an intermediate curved portion 336, 338, respectively. The foot portions 332, 334 are adapted, when mounted on for example the rail 20 of the frame 12, to contact the underside surface of the rail. The foot portions 322, 324 also include a carved out or open portion that includes a vertically extending first groove 340, 340 that is complementary in shape to the rib portion 25 of the rails 16, 18, 20, 22 and that is formed on an upper portion of the foot portion, as well as a separate, spaced apart second groove 344, 344 that is sized and configured for mating with a portion of a locking element, such as for example one of the wedge bolts 34, 36. The second groove 344 is formed on a lower portion of the foot portion. The foot portions 322, 324 also include an upper contact region that includes an upper contact portion 346, 346. The upper contact regions 346, 346 are adapted, when mounted on for example the rail 20 of the frame 12, to contact the topside surface of the rail 20.

Figure 34:
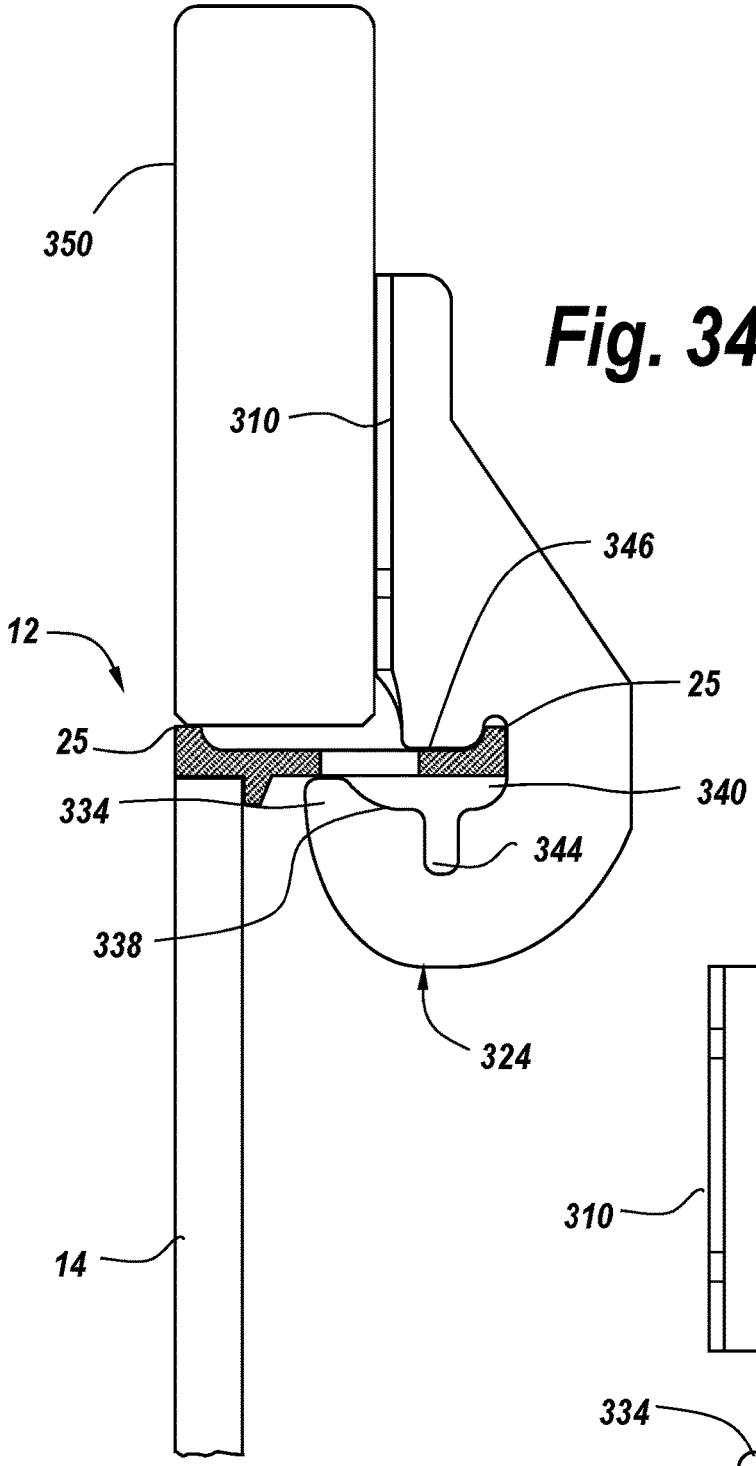
FIG. 34 is a side view of the stacking clip of FIG. 30 mounted on a frame 12 of a concrete forming system and having a custom panel secured thereto and showing the various contact points of the stacking clip.
Figure 35:
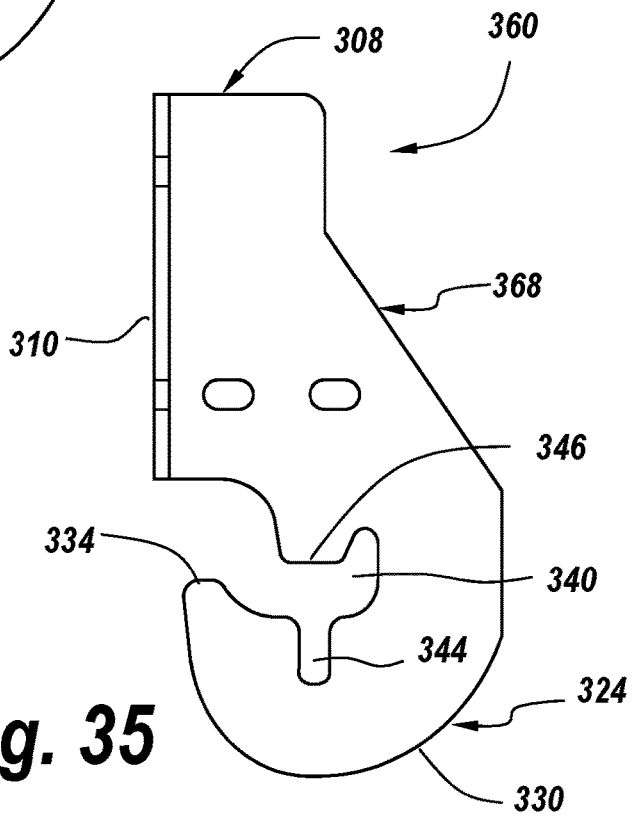
FIG. 35 is a side view of a second embodiment of the stacking clip according to the teachings of the present invention.
Figure 36:
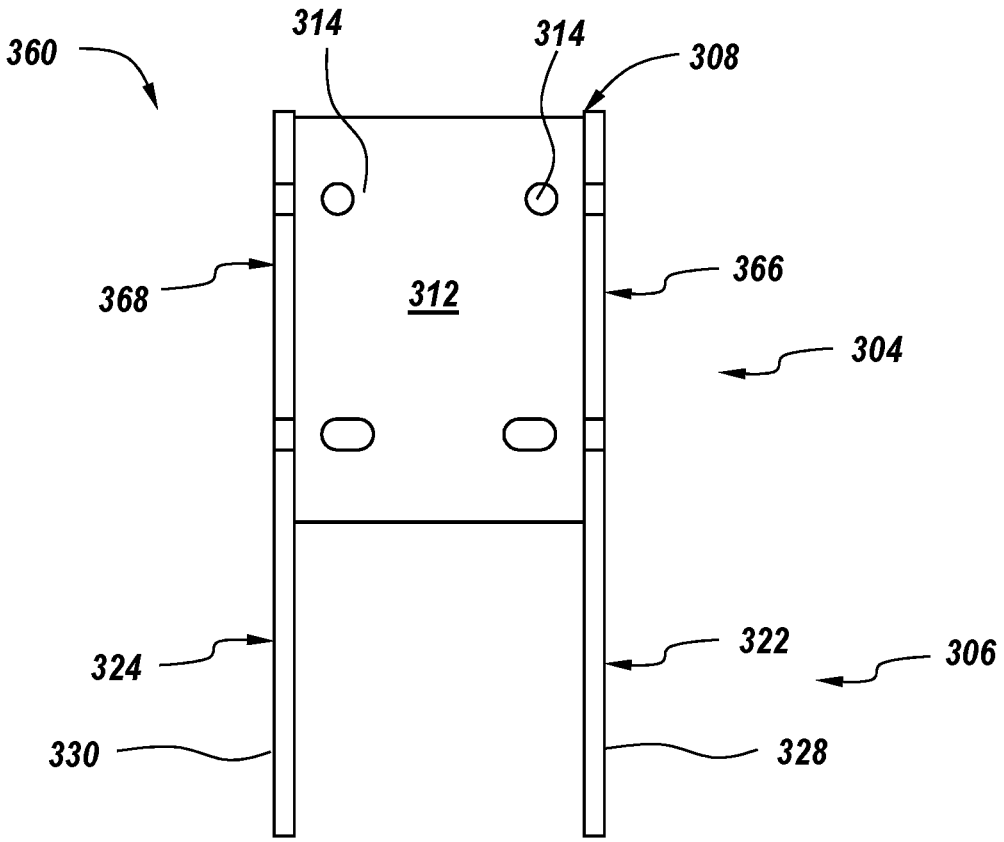
FIG. 36 is a rear view of the stacking clip of FIG. 35.
Figure 37:
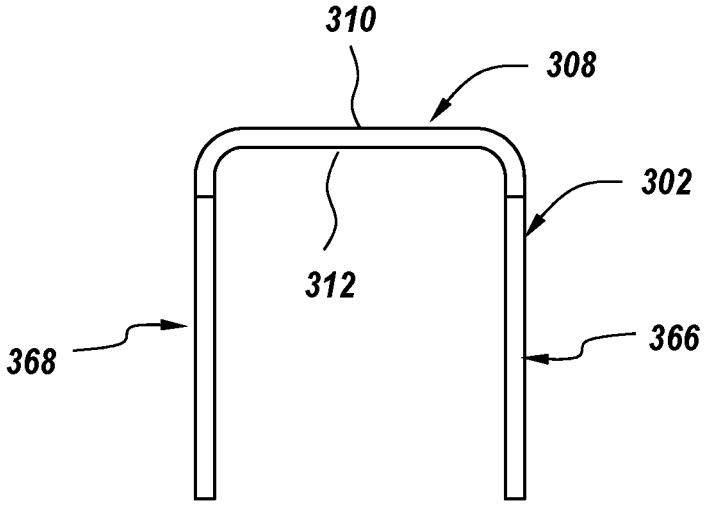
FIG. 37 is a top view of the stacking clip of FIG. 35.

In use, and as shown in FIG. 34, the illustrated stacking clip 300 can be mounted to, for example, the top rail 20 of the metal frame 12. When mounted thereon, the rail is inserted into the open region of the clip until the rib 25 seats within the first groove 340 and the upper contact region 346 contacts the topside surface of the rail 20. Further, when mounted on the rail 20, the finger portions 332, 334 contact the underside or bottom surface of the rail 20. The user of the clips can also fashion the appropriate sized extension component, such as the custom panel 350. In the illustrated embodiment, the custom panel 350 is mounted on the top of the frame 12 and is secured to the upper portion 304 of the stacking clip 300, and specifically to the face region 308 by way of suitable fasteners (not shown) that are mounted within the apertures 314. In the illustrated stacking clip 300, the bent portions 316, 318 are sized and configured so as to allow a custom panel of about 1.5 inches in thickness to be secured thereto. As such, the front face 310 of the face region 308 is separated from the finger portions 332, 334 a sufficient distance so as to accommodate the thickness of the custom panel 350 in a manner that allows a front face of the panel 350 to be aligned with and in registration with the panel 14, while concomitantly allowing the finger portions 332, 334 to contact and engage with the underside of the rail 20. The alignment of the front faces of the panels 14, 370 provides for a relatively flat wall when fully formed. More specifically, the front face 310 of the upper portion 304 extends in a first plane that is transverse to a second plane encompassing the finger portions 332, 334 of the first and second foot portions 322, 324, and wherein the first plane is spaced apart from the finger portions in the direction of the second plane.

The user can also mount the illustrated stacking clip 300 to one of the side rails 16, 18 in a similar manner. For example, in the case where the custom panel is intended to be mounted alongside of one of the frames 12, the stacking clips are mounted to, for example, the rail 18. Similar to above when mounted to the top rail 20, the rib 25 mounts or seats within the first grooves 340, 340 and the upper contact region 346 contacts the topside surface of the rail 18. Further, when mounted on the rail 18, the finger portions 332, 334 contact the underside surface of the rail 18. The custom panel 350 can then be secured to the clip 300 via the fasteners. Further, the clip can be secured to the frame 12 by a suitable locking element, such as by the wedge bolt 34, by seating the wedge bolt in the second grooves 344 formed in the foot portions 322, 324.

FIGS. 35-38 illustrate a second embodiment of the stacking clip 360 according to the teachings of the present invention. Like reference numerals indicate the same or similar structure. Similar to the stacking clip 300, the illustrated stacking clip 360 includes a main body 302 having an upper portion 304 and a lower portion 306. The upper portion 304 functions as a custom panel support region for securing the custom panel 370 thereto, FIG. 38. The upper portion 304 has a relatively flat face region 308 having a relatively flat front face 310 and a relatively flat rear face 312. The face region 308 also includes a plurality of fastener receiving apertures 314 formed therein. The apertures 314 are sized and configured to receive one or more known fasteners, such as nails or screws, for securing the custom panel 370 to the face region 308, and specifically to the front face 310.

The bottom portion 306 of the stacking clip 300 is coupled to the upper portion 304 by way of a pair of opposed flange or bent portions 366, 368. The size or thickness of the bent portions dictates the space or separation between front most portion of the lower portion 306 and the front face 310 of the face region 308. The separation or distance between these two portions dictates the thickness of the custom plywood panel that can be secured to the stacking clip 300. The bent portions are configured to overly the finger portions 332, 324 and hence the stacking clip 360 is adapted to be mounted to custom plywood panels 370 of smaller thicknesses, such as for example, a thickness of about 0.75 inches. The bent portions 316, 318 are integrally formed with the upper portion 304 and extend outwardly from the rear face 312 thereof.

The lower portion 306 of the stacking clip 300 includes a pair of spaced apart foot portions 322, 324. Each of the foot portions 322, 324 includes a curved main body 328, 330, respectively. Each of the curved main bodies 328, 330 has a generally C-shaped configuration and is integrally formed with the bent portions 316, 318 at one end and terminates at an opposed end in a contact portion or region. Each of the contact regions of the foot portions includes a finger portion 332, 334 that transitions to an intermediate curved portion 336, 338, respectively. The foot portions 332, 334 are adapted, when mounted on for example the rail 20 of the frame 12, to contact the underside or bottom surface of the rail. The foot portions 322, 324 also include a carved out or open portion that includes a vertically extending first groove 340, 340 that is complementary in shape to the rib portion 25 of the rails 16, 18, 20, 22, as well as a separate, spaced apart second groove 344, 344 that is sized and configured for mating with a portion of one of the wedge bolts 34, 36. The foot portions also include an upper contact region that includes an upper contact portion 346, 346. The upper contact regions 346, 346 are adapted, when mounted on for example the rail 20 of the frame 12, to contact the topside surface of the rail 20.

Figure 38:
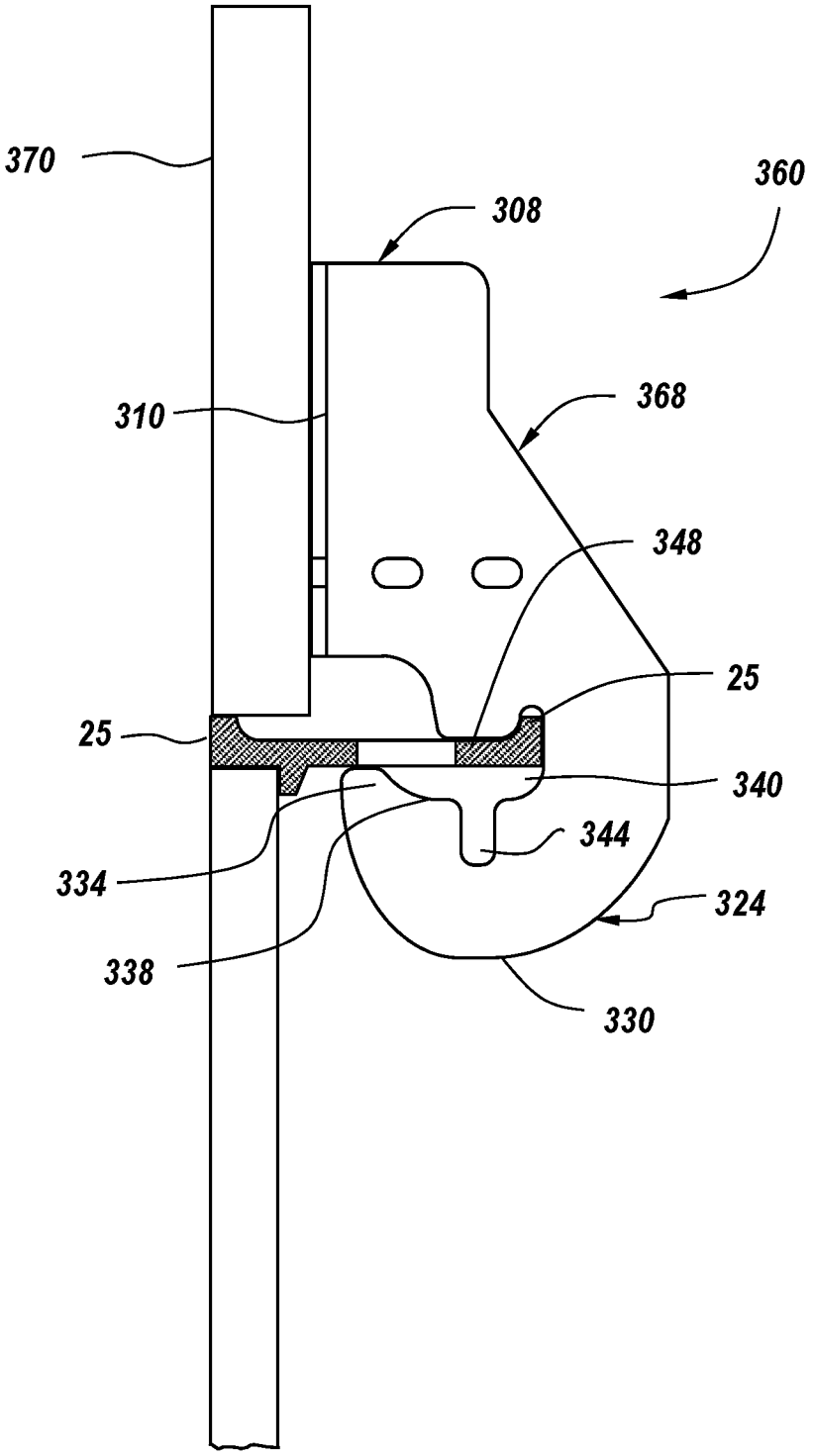
FIG. 38 is a side view of the stacking clip of FIG. 35 mounted on a frame 12 of a concrete forming system and having a custom panel secured thereto and showing the various contact points of the stacking clip.

In use, and as shown in FIG. 38, the illustrated stacking clip 360 can be mounted to, for example, the top rail 20 of the metal frame 12. When mounted thereon, the rail is inserted into the open region of the clip 360 until the rib 25 seats within the first groove 340 and the upper contact region 346 contacts the topside surface of the rail 20. Further, when mounted on the rail 20, the finger portions 332, 334 contact the underside surface of the rail 20. The user of the clips can also fashion the appropriate sized extension component, such as the custom panel 370. In the illustrated embodiment, the custom panel 370 is mounted on the top of the frame 12 and is secured to the upper portion 304 of the clip, and specifically to the front face 10 of the face region 308 by way of suitable fasteners (not shown) that are mounted within the apertures 314. In the illustrated stacking clip 360, the bent portions 366, 368 are sized and configured so as to allow the custom plywood panel of about 0.75 inches in thickness to be secured thereto. As such, the bent portions 366, 368 and the front face 310 of the face region 308 overlies the finger portions 332, 334 so as to accommodate the thickness of the custom panel 370 in a manner that allows a front face of the panel 370 to be aligned with and in registration with the panel 14 while concomitantly allowing the finger portions to contact and engage with the underside of the rail. The alignment of the front faces of the panels 14, 370 provides for a relatively flat wall when formed.

The stacking clip 300, 360 of the present invention can be mounted to any one of the horizontal and vertical side rails 16, 18, 20, 22 of the metal frame 12. The stacking clip has a main body having a relatively flat upper portion for seating and attaching thereto an extension component, such as a custom plywood panel 350, 370. The stacking clip also has a pair of C-shaped foot portions having an upper portion having a slot or notch formed therein for seating on and mating with the raised edge, lip or rib portion of the side rails. The flat upper portion also includes a plurality of fastener receiving apertures for receiving fasteners, such as nails or screws, for securing the extension component thereto. The lower portion of each of the foot portions can include one or more slots formed therein for receiving a fastening element, such as for example the wedge bolt, for securing the stacking clip to the panel. The foot portions terminate in a raised finger portion that mates with the underside of the rail opposite the slot in the upper portion.

The foregoing description may provide illustration and description of various embodiments of the invention, but is not intended to be exhaustive or to limit the invention to the precise form disclosed. Modifications and variations of the tie rod of the present invention may be possible in light of the above teachings or may be acquired from practice of the invention.

For example, while a series of acts has been described above, the order of the acts may be modified in other implementations consistent with the principles of the invention. Further, non-dependent acts may be performed in parallel.

In addition, one or more implementations consistent with principles of the invention may be implemented using one or more devices and/or configurations other than those illustrated in the Figures and described in the Specification without departing from the spirit of the invention. One or more devices and/or components may be added and/or removed from the implementations of the figures depending on specific deployments and/or applications. Also, one or more disclosed implementations may not be limited to a specific combination of hardware. Furthermore, certain portions of the invention may be implemented as logic that may perform one or more functions. This logic may include hardware, such as hardwired logic, an application-specific integrated circuit, a field programmable gate array, a microprocessor, software, or a combination of hardware and software.

No element, act, or instruction used in the description of the invention should be construed critical or essential to the invention unless explicitly described as such. Also, as used herein, the article "a" is intended to include one or more items. Where only one item is intended, the term "a single" or similar language is used. Further, the phrase "based on," as used herein is intended to mean "based, at least in part, on" unless explicitly stated otherwise. In addition, the term "user", as used herein, is intended to be broadly interpreted to include, for example, an electronic device (e.g., a workstation) or a user of an electronic device, unless otherwise stated.

Further, the invention can be employed using any combination of features or elements as described above, and are not limited to the current recited steps or features.

It is intended that the invention not be limited to the particular embodiments disclosed above, but that the invention will include any and all particular embodiments and equivalents falling within the scope of the following appended claims.

The invention claimed is:

1. A stacking clip suitable for use with a concrete forming system having one or more frame elements having one or more ribs formed on a rail, comprising a main body having an upper portion and a lower portion, wherein the upper portion is coupled to the lower portion by way of a pair of opposed first and second bent portions, wherein the upper portion has a relatively flat face region having a relatively flat front face, wherein the lower portion includes first and second foot portions, each of which includes a curved main body having a generally C-shaped configuration, the curved main body having a first groove formed on an upper portion of the curved main body for seating the rib of the rail and having an opening when positioned in use at a vertically bottom-most portion of the first groove, an upper contact region separate and distinct from the first groove formed on the upper portion of the curved main body and immediately adjacent to the first groove and having a contact surface for contacting a top surface of the rail, a second groove disposed on a lower portion of the curved main body, and a lower contact region formed at an end of the lower portion of the curved body for contacting a bottom surface of the rail, wherein the upper contact region formed on the upper portion of the curved main body completely overlies the second groove formed on a lower portion of the main body.

2. The stacking clip of claim 1, wherein the upper portion of the main body has a plurality of fastener-receiving apertures formed therein, wherein the fastener-receiving apertures are circular or oval in shape.

3. The stacking clip of claim 1, wherein the lower contact region of the first and second foot portions has a finger portion for contacting the bottom surface of the rail and a curved portion adjacent the finger portion.

4. The stacking clip of claim 1, wherein the first and second bent portions are integrally formed with the upper portion and extend outwardly from a rear surface of the upper portion.

5. The stacking clip of claim 4, wherein the first bent portion is coupled to the upper portion at one end and to the first foot portion at the opposed end.

6. The stacking clip of claim 5, wherein the second bent portion is coupled to the upper portion at one end and to the second foot portion at the opposed end.

7. The stacking clip of claim 1, wherein the front face of the upper portion extends in a first plane that is transverse to a second plane encompassing the finger portions of the first and second foot portions, and wherein the first plane is spaced apart from the finger portions in the direction of the second plane.

8. The stacking clip of claim 1, wherein the first and second bent portions overlie the finger portions of the first and second foot portions.

9. A stacking clip suitable for use with a concrete forming system having one or more frame elements having one or more ribs formed on a rail, comprising a main body having an upper portion and a lower portion, wherein the upper portion is coupled to the lower portion by way of a pair of opposed first and second bent portions, wherein the upper portion has a relatively flat face region having a relatively flat front face, wherein the lower portion includes first and second foot portions, each of which includes a curved main body having a generally C-shaped configuration, the curved main body having a first groove formed on an upper portion of the curved main body for seating the rib of the rail, an upper contact region formed on the upper portion of the curved main body adjacent to the first groove and having a contact surface for contacting a top surface of the rail, a second groove disposed on a lower portion of the curved main body, and a lower contact region formed at an end of the lower portion of the curved body for contacting a bottom surface of the rail, wherein the first and second bent portions overlie the finger portions of the first and second foot portions.

* * * * *